US008770959B2

(12) United States Patent
Chase et al.

(10) Patent No.: US 8,770,959 B2
(45) Date of Patent: Jul. 8, 2014

(54) DEVICE FOR PRODUCING ELECTROSPUN FIBERS

(75) Inventors: George Chase, Wadsworth, OH (US); Kitchaporn Nartetamrongsutt, Bangrak Bangkok (TH); Jackapon Sunthorn Varabhas, Taweewattana Bangkok (TH); Gary Carlson, Broomfield, CO (US); Seth Finley, Copper Mountain, CO (US)

(73) Assignee: University of Akron, Akron, OH (US)

( * ) Notice: Subject to any disclaimer, the term of this patent is extended or adjusted under 35 U.S.C. 154(b) by 313 days.

(21) Appl. No.: 13/159,610

(22) Filed: Jun. 14, 2011

(65) Prior Publication Data

US 2012/0064186 A1 Mar. 15, 2012

Related U.S. Application Data

(63) Continuation-in-part of application No. 11/913,073, filed as application No. PCT/US2006/016961 on May 3, 2006, now Pat. No. 7,959,848.

(60) Provisional application No. 60/677,173, filed on May 3, 2005.

(51) Int. Cl.
*D01D 5/26* (2006.01)

(52) U.S. Cl.
USPC ..... 425/174.8 E; 425/376.1; 425/461

(58) Field of Classification Search
USPC ..... 425/83.1, 174.8 E, 376.1, 461
See application file for complete search history.

(56) References Cited

U.S. PATENT DOCUMENTS

| | | | | |
|---|---|---|---|---|
| 1,975,504 | A | 10/1934 | Formhals et al. | |
| 4,230,650 | A * | 10/1980 | Guignard | 264/441 |
| 6,616,435 | B2 | 9/2003 | Lee et al. | |
| 6,641,773 | B2 | 11/2003 | Kleinmeyer et al. | |
| 6,695,992 | B2 | 2/2004 | Reneker et al. | |
| 6,713,011 | B2 | 3/2004 | Chu et al. | |
| 6,753,454 | B1 | 6/2004 | Smith et al. | |
| 7,351,052 | B2 | 4/2008 | Chun et al. | |
| 7,959,848 | B2 * | 6/2011 | Reneker et al. | 264/465 |
| 2009/0127748 | A1 * | 5/2009 | Takahashi | 264/465 |

FOREIGN PATENT DOCUMENTS

| | | |
|---|---|---|
| KP | 10-406981 | 11/2003 |
| WO | WO 2004016839 A1 * | 2/2004 |
| WO | W02004080681 | 9/2004 |

OTHER PUBLICATIONS

Reneker, D.H. and I. Chun, "Nanometer Diameter Fibers of Polymer, Produced by Electrospinning", Nanotechnology, 1996, 216 to 223, vol. 7.

Reneker, D.H., A.L. Yarin, H. Fong, & S. Koombhongse, "Bending Instability of Electrically Charged Liquid Jets of Polymer Solutions . . . ," J. Appl. Phys., 87, 4531, 2000.

(Continued)

*Primary Examiner* — Yogendra Gupta
*Assistant Examiner* — Joseph Leyson
(74) *Attorney, Agent, or Firm* — Renner Kenner Greive Bobak Taylor & Weber

(57) ABSTRACT

Electrospinning nozzles include novel constructs for providing spinning pores that define the origin of jets of fiber-forming media. In some embodiments, a film covers relatively large holes in a nozzle body and provides spinning pores aligned with such large holes. In some embodiments, conductive tubes are secured at or about relatively large holes in a nozzle body and provide spinning pores fluidly communicating with fiber-forming media at such large holes. In yet other embodiments, nozzle bodies are provided with circular or semi-spherical surfaces having a plurality of spinning pores.

3 Claims, 22 Drawing Sheets

(56) References Cited

OTHER PUBLICATIONS

Yarin, A.L., S. Koombhongse, and D.H. Reneker, "Bending Instability in Electrospinning of Nanofibers", J. Appl. Phys., 89, 3018, 2001.

Hohman, M.M., M. Shin, G. Rutledge, and M.P. Brenner, " Electrospinning and Electrically Forced Jets: II Aplications", Phys. Fluids, 13, 2221, 2001.

Yarin, A.L., E. Zussman, "Upward Needless Electrospinning of Multiple Nanofibers", Polymer, 45, 2977 to 2980, 2004.

* cited by examiner

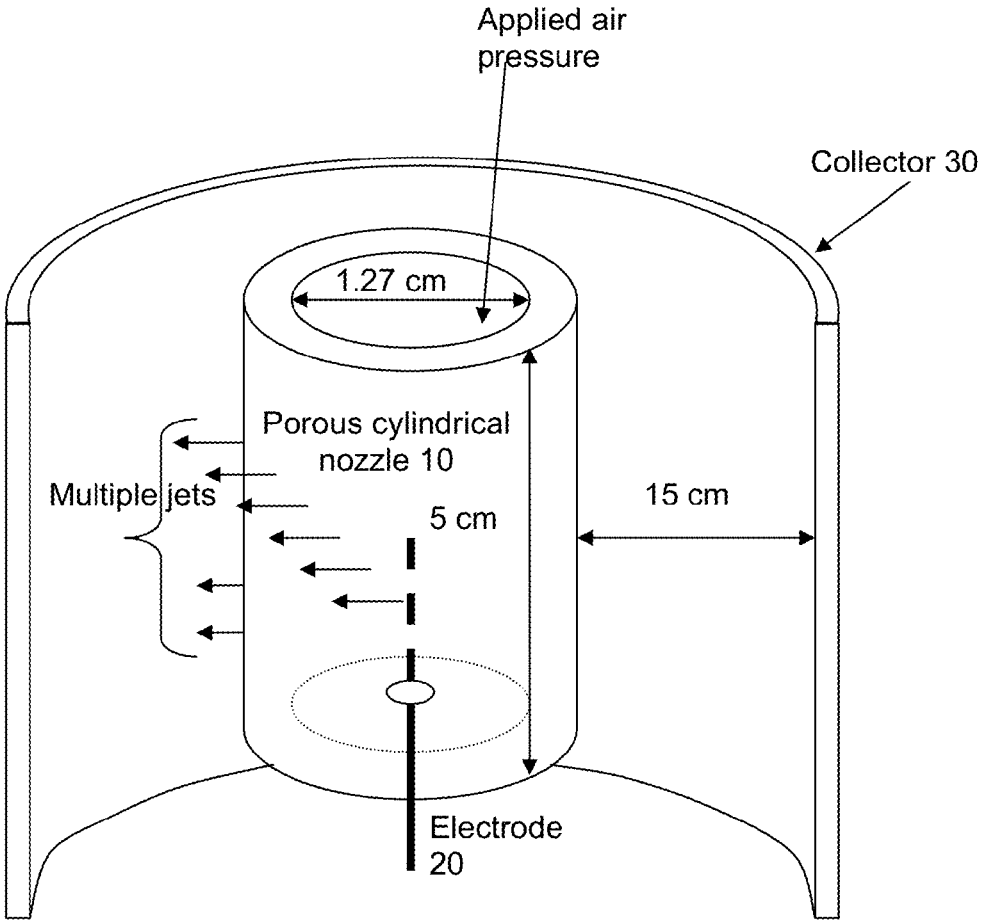
Figure 1: Cutaway view showing the cylindrical porous nozzle within the cylindrical collector.

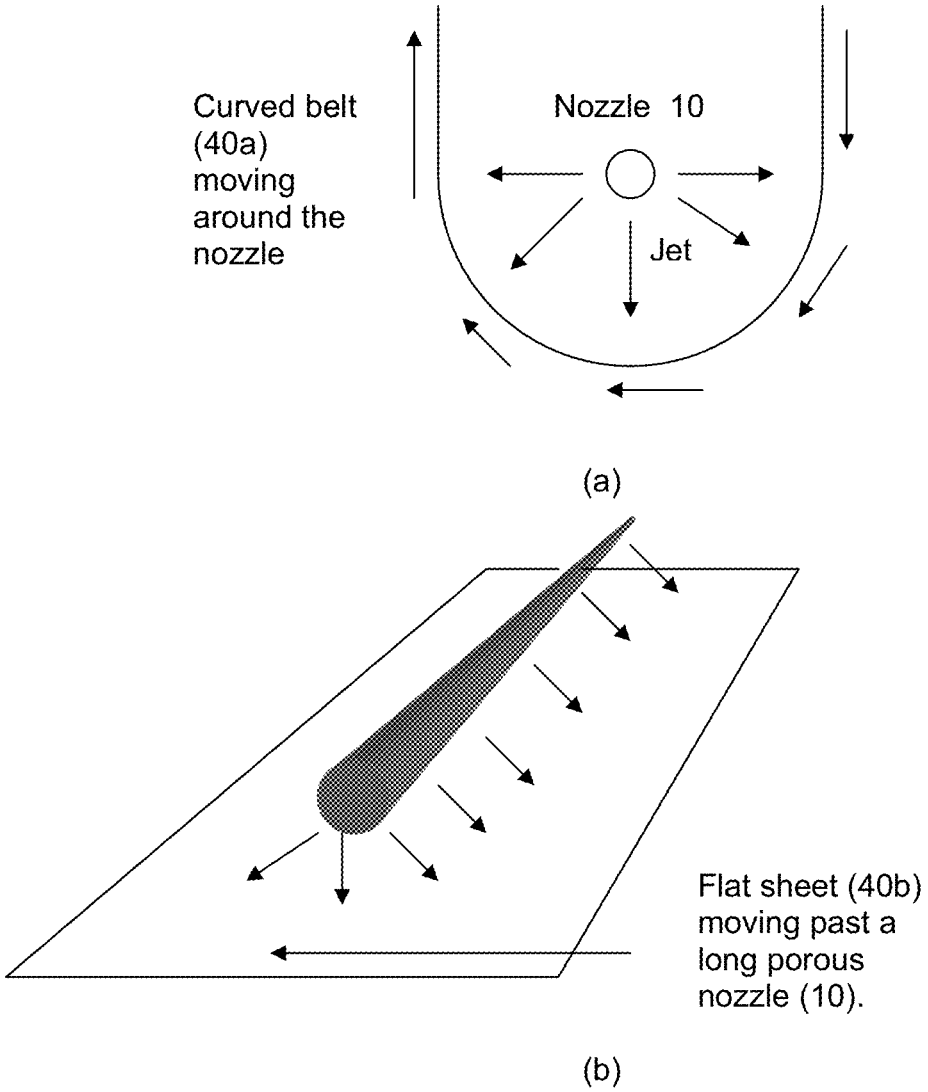
Figure 2: The collector could be constructed as a moving belt for collecting large sheets of fibers. The belt could move around the nozzle as shown in (a) or may be a flat sheet as shown in (b). (b) shows the porous nozzle as a long tube (or conical tube).

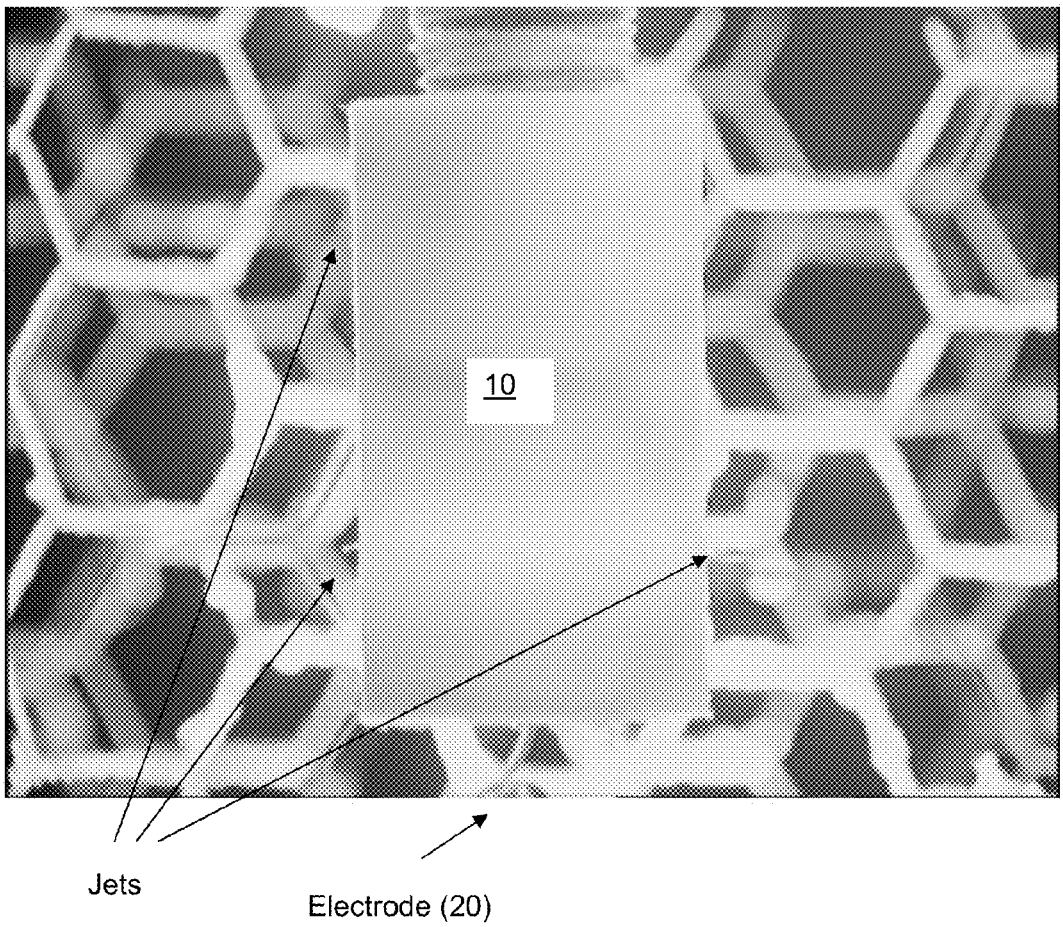
Figure 4a. The porous nozzle sits in the center of a cylindrical wire mesh. Jets of Nylon 6 solution protrude from the walls of the nozzle. The wire electrode enters the nozzle from the bottom.

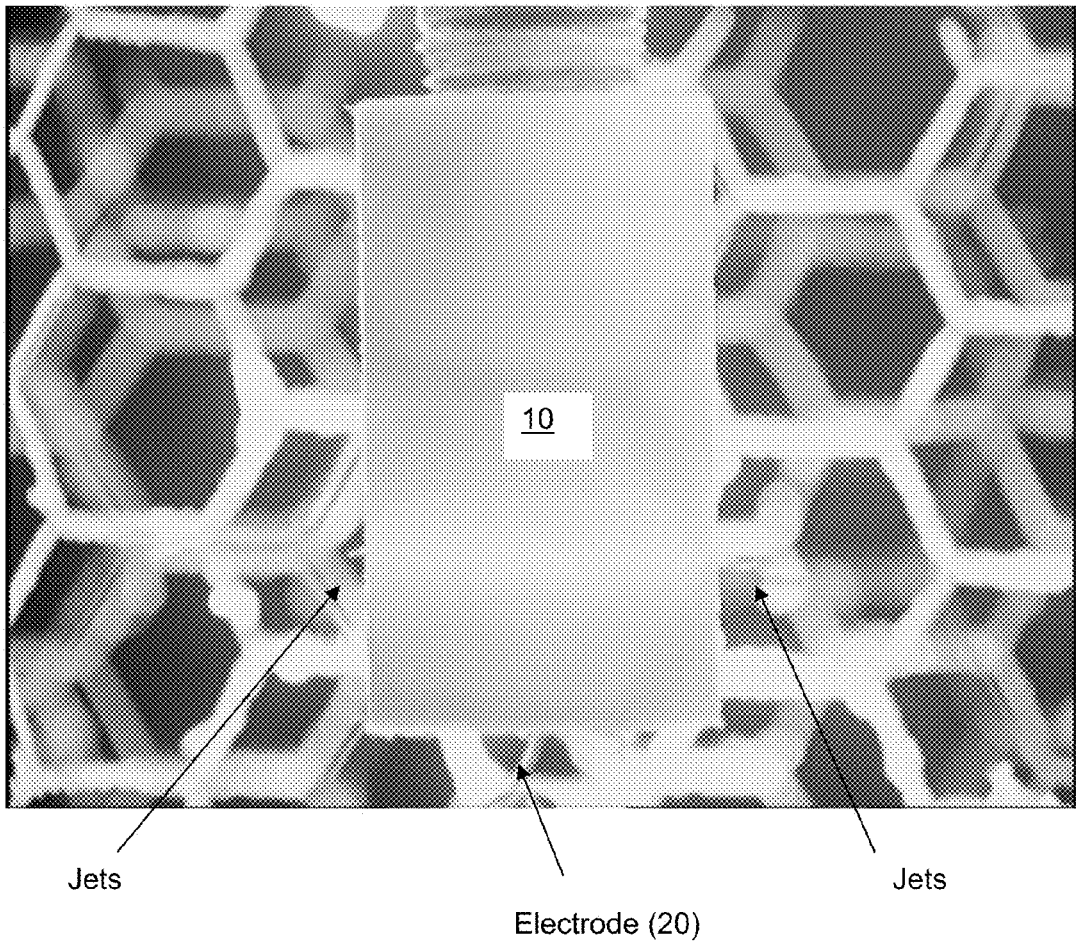
Figure 4b. The porous nozzle sits in the center of a cylindrical wire mesh. Jets of Nylon 6 solution protrude from the walls of the nozzle.

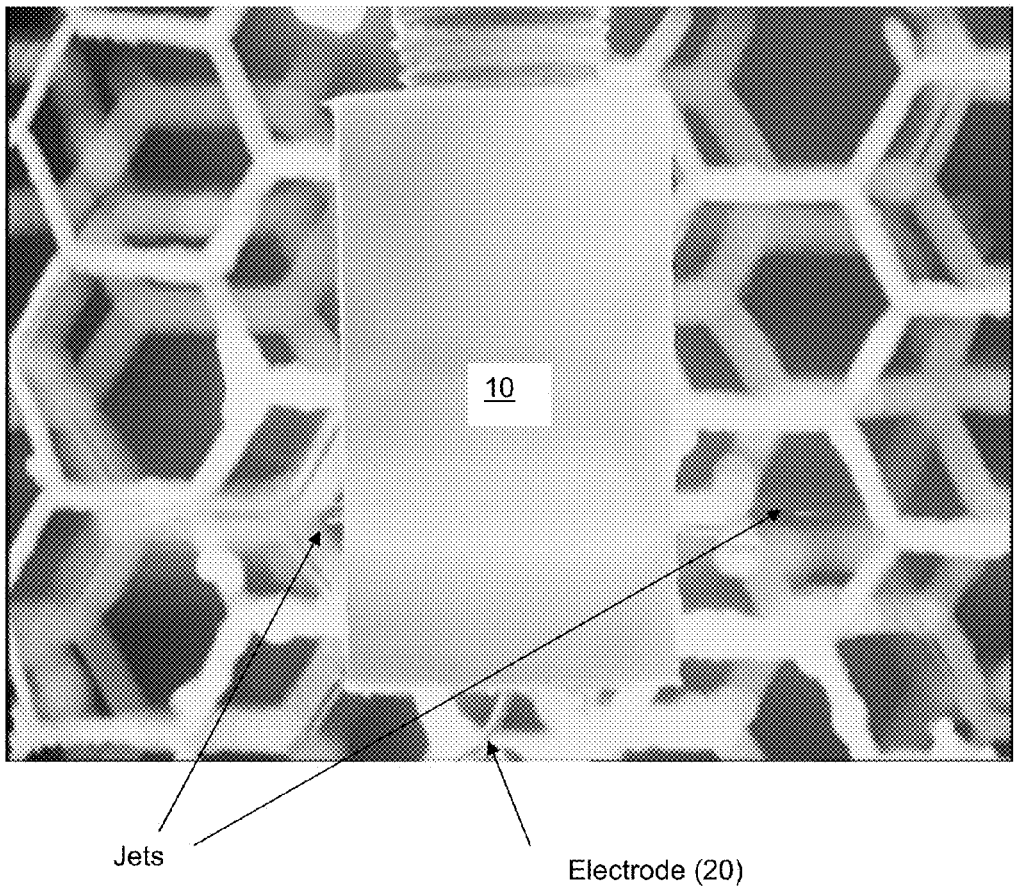
Figure 4c. The porous nozzle sits in the center of a cylindrical wire mesh. Jets of Nylon 6 solution protrude from the walls of the nozzle.

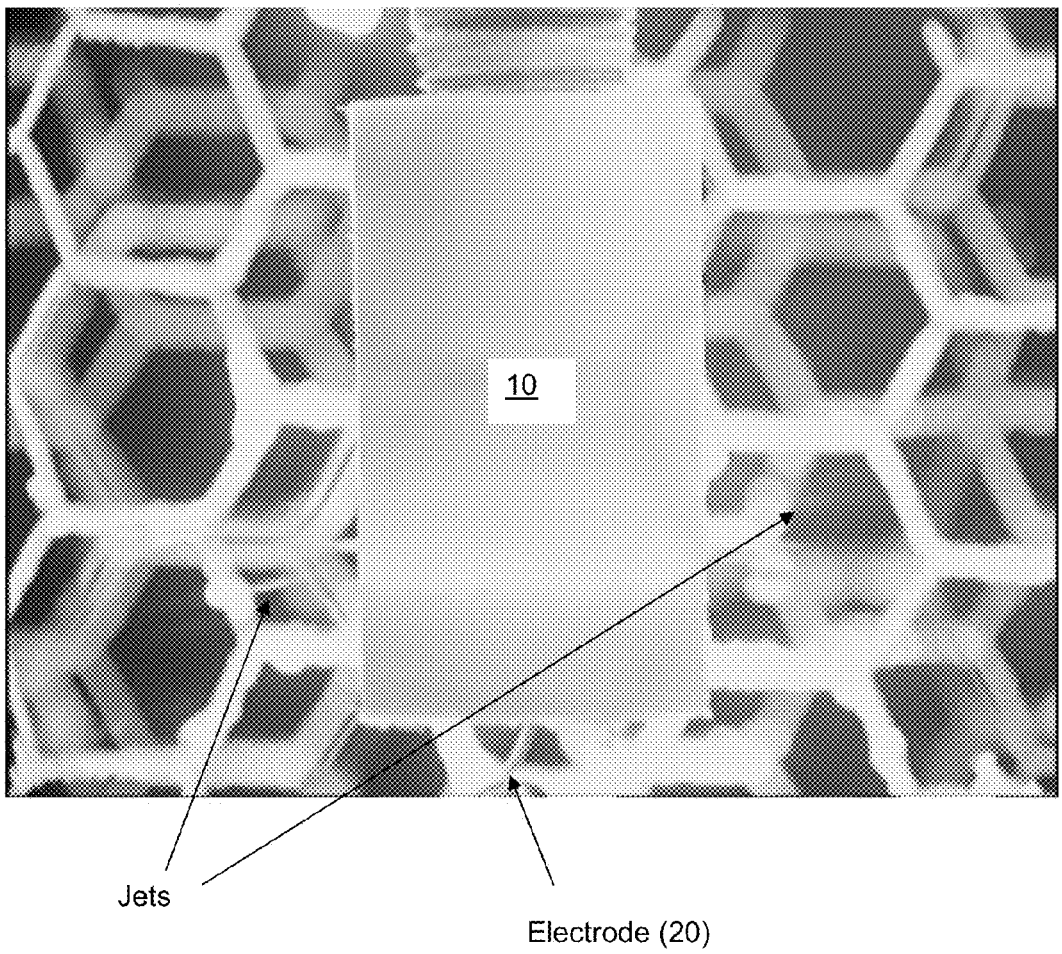
Figure 4d. The porous nozzle sits in the center of a cylindrical wire mesh. Jets of Nylon 6 solution protrude from the walls of the nozzle.

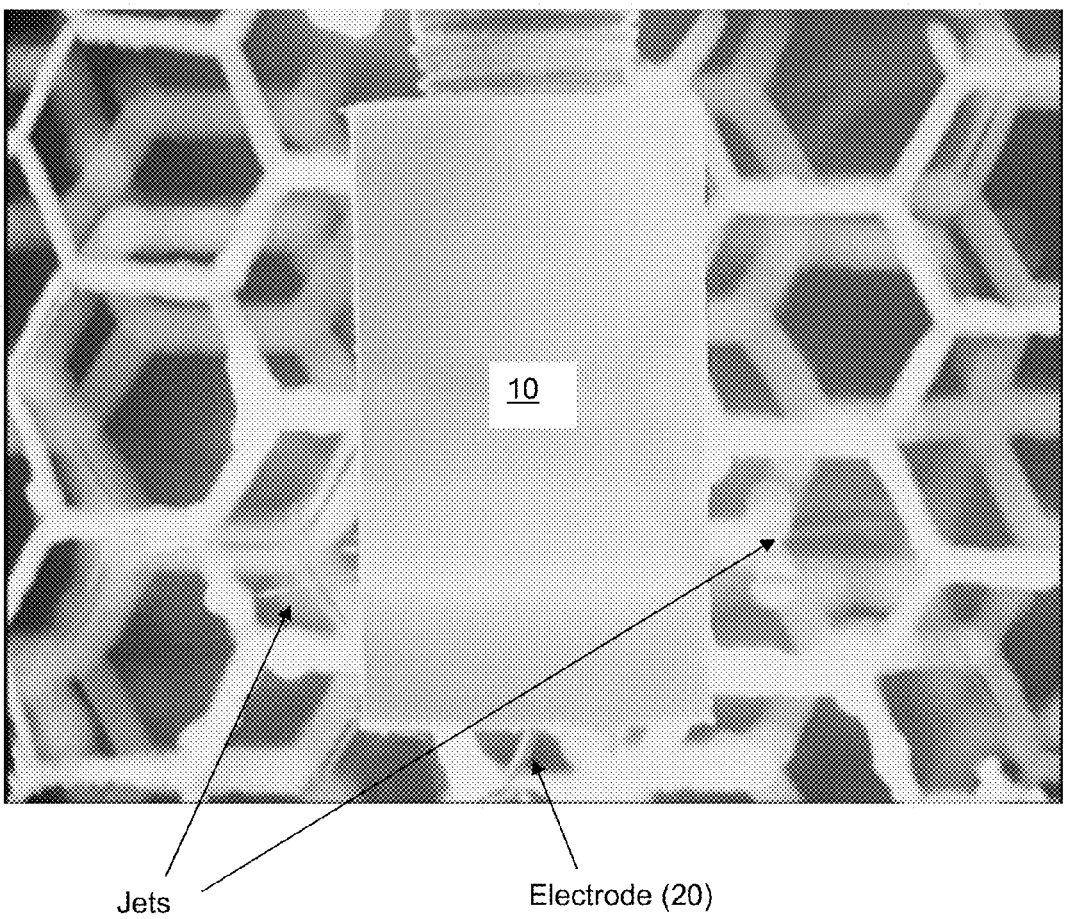
Figure 4e. The porous nozzle sits in the center of a cylindrical wire mesh. Jets of Nylon 6 solution protrude from the walls of the nozzle.

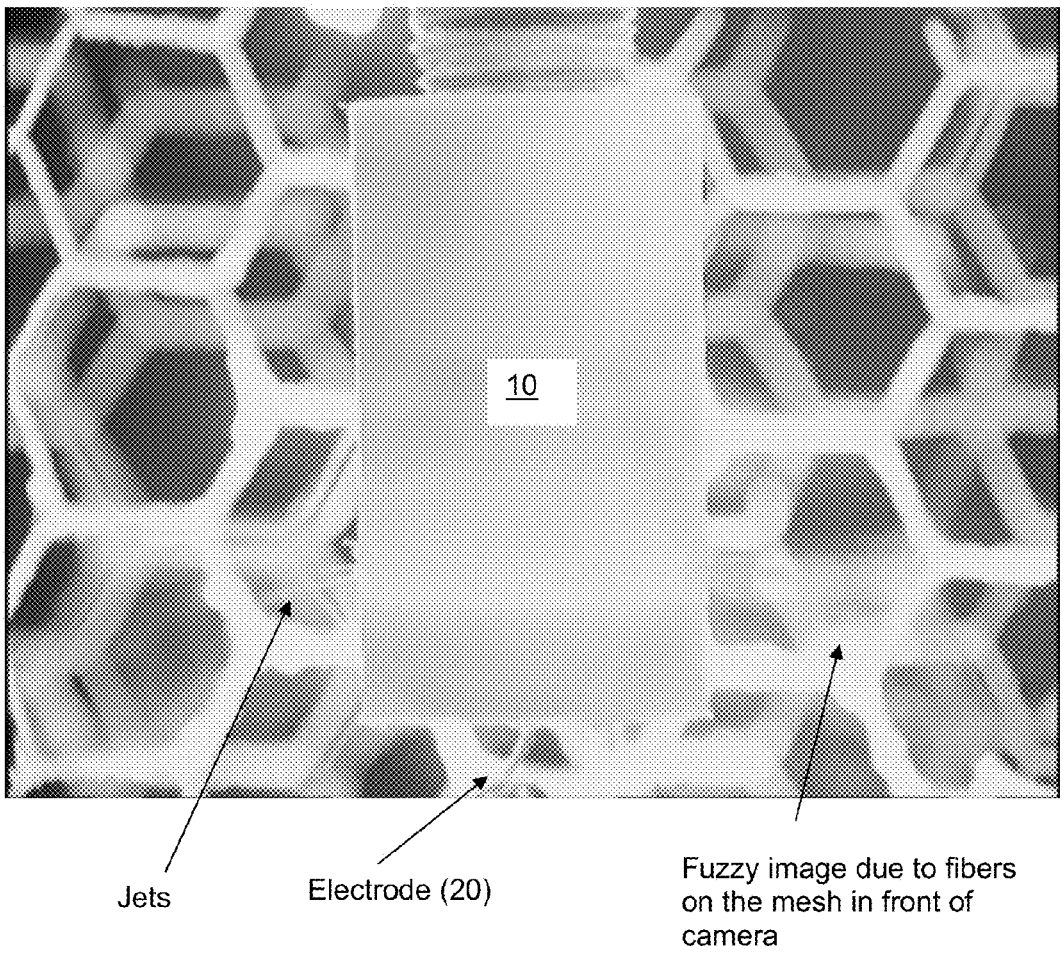
Figure 4f. The porous nozzle sits in the center of a cylindrical wire mesh. Jets of Nylon 6 solution protrude from the walls of the nozzle.

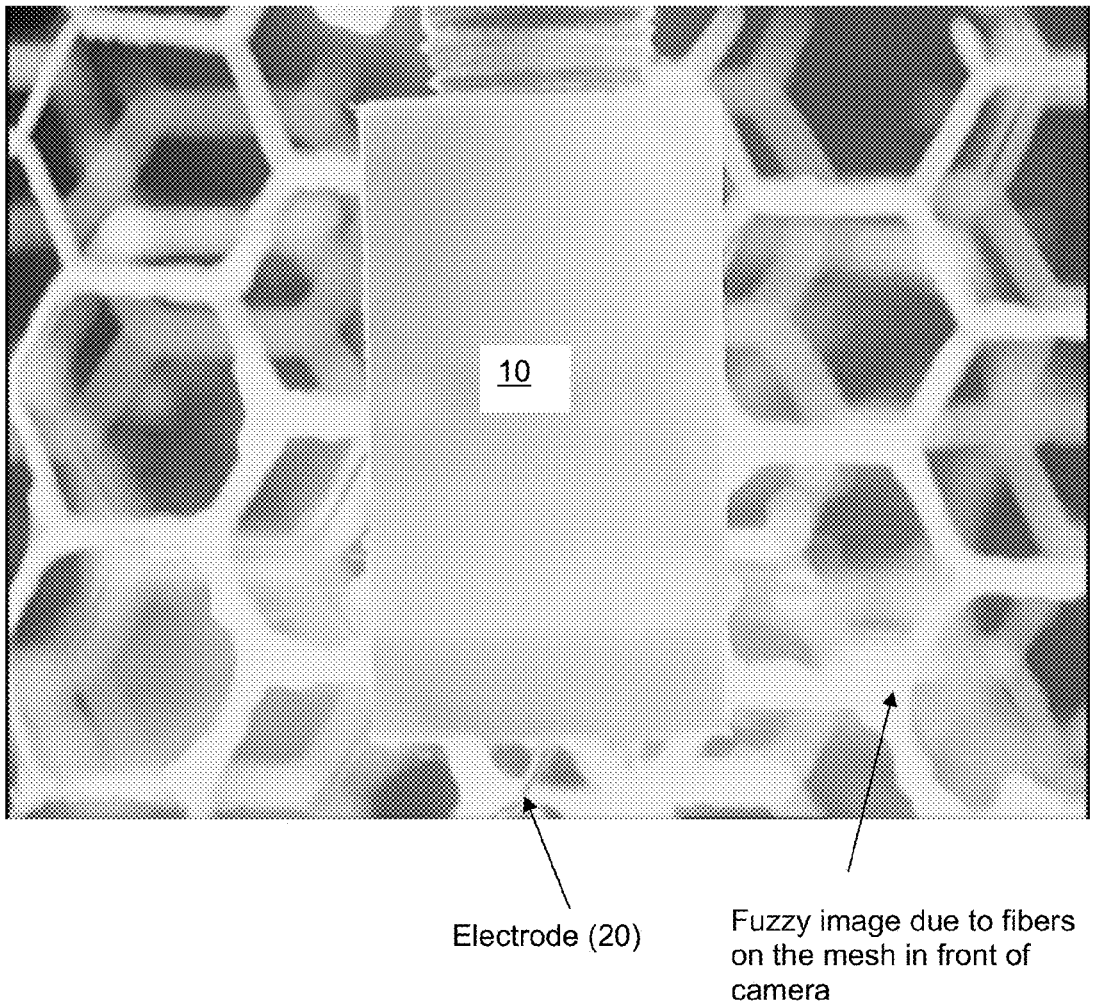
Figure 4g. The porous nozzle sits in the center of a cylindrical wire mesh. Jets of Nylon 6 solution protrude from the walls of the nozzle.

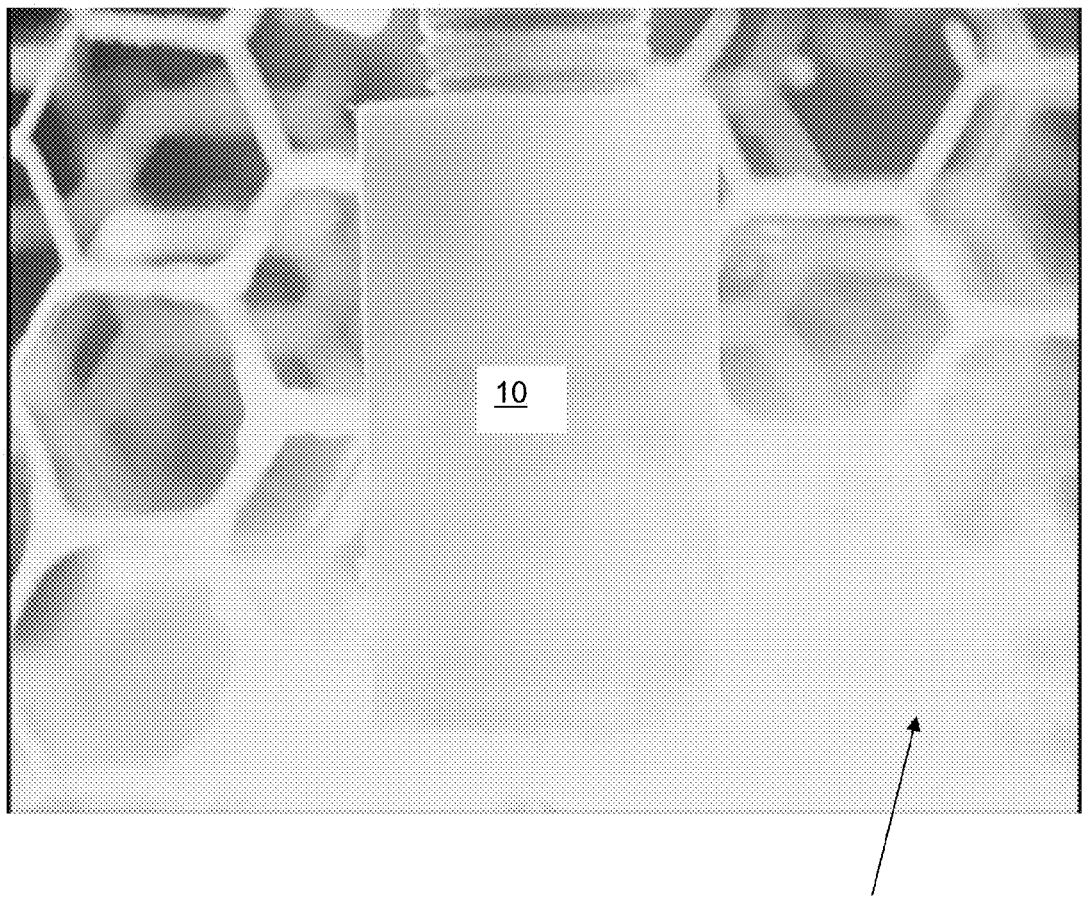
Figure 4h. The porous nozzle sits in the center of a cylindrical wire mesh. Jets of Nylon 6 solution protrude from the walls of the nozzle.

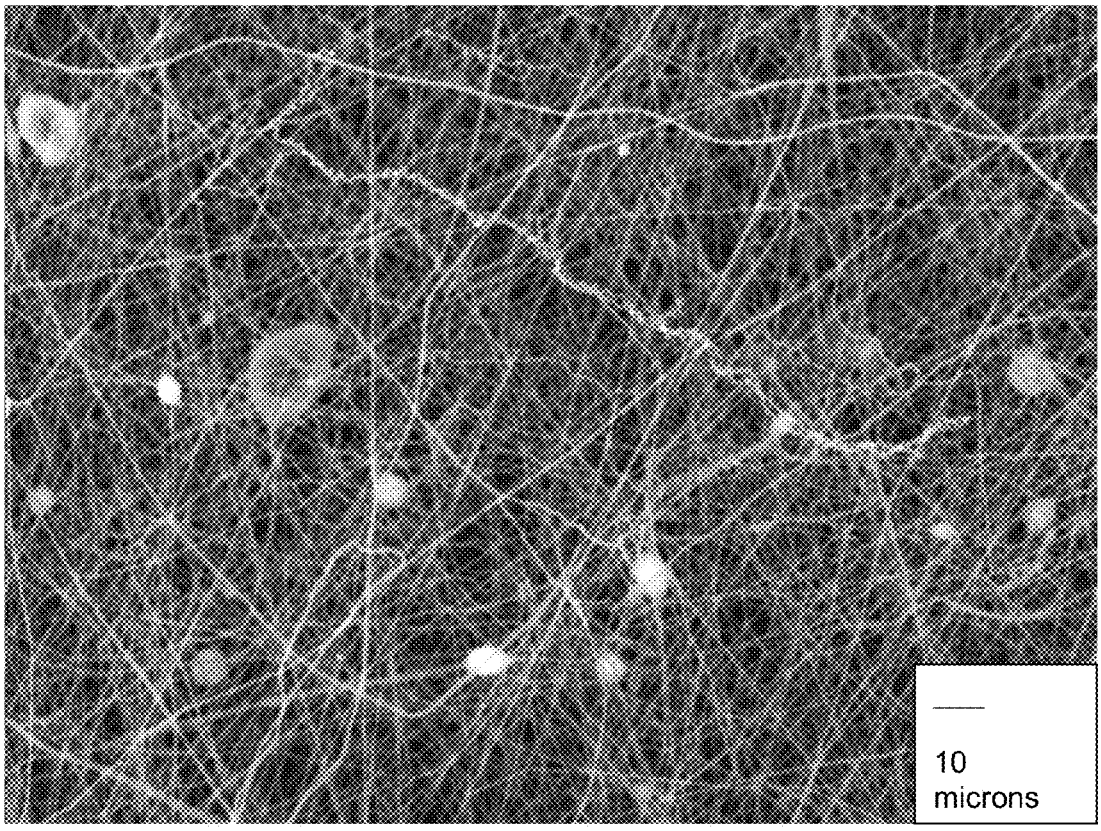
Figure 5a. SEM image of Nylon 6 fibers produced by electrospinning from a porous nozzle.

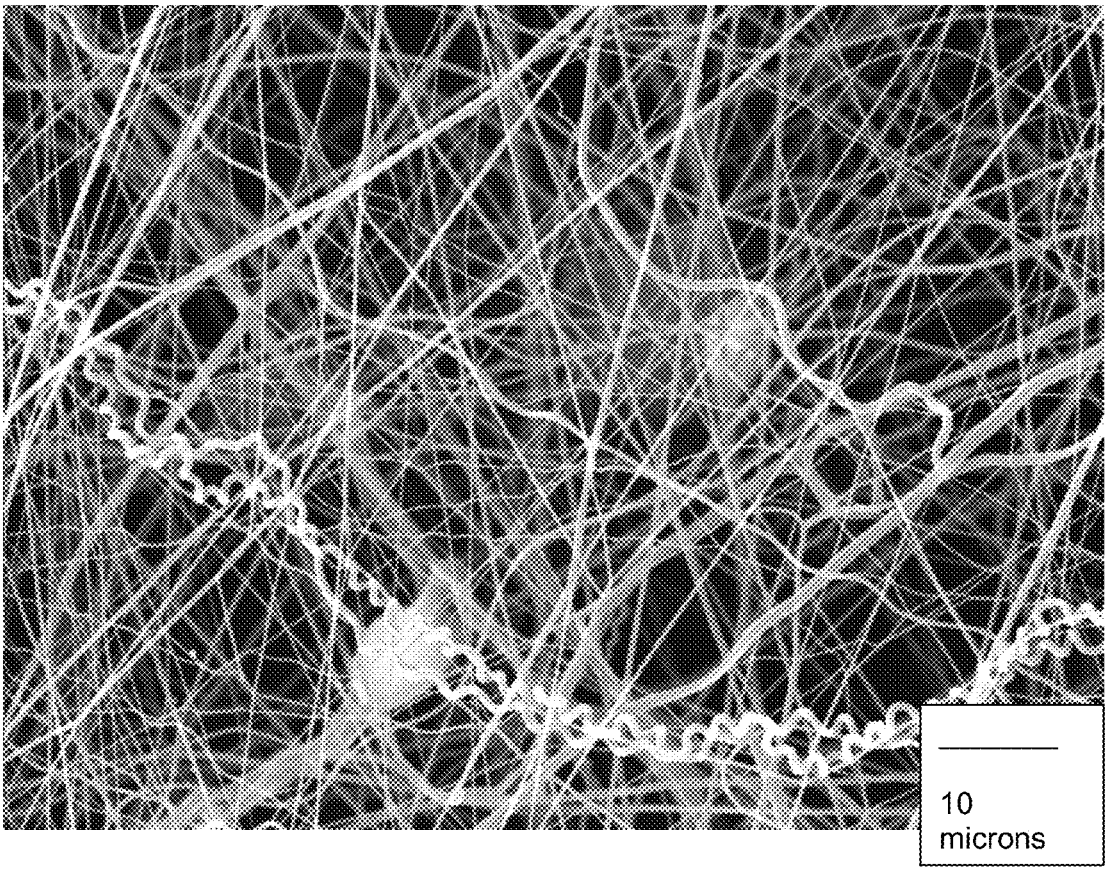
Figure 5b. SEM image of Nylon 6 fibers produced by electrospinning from a porous nozzle.

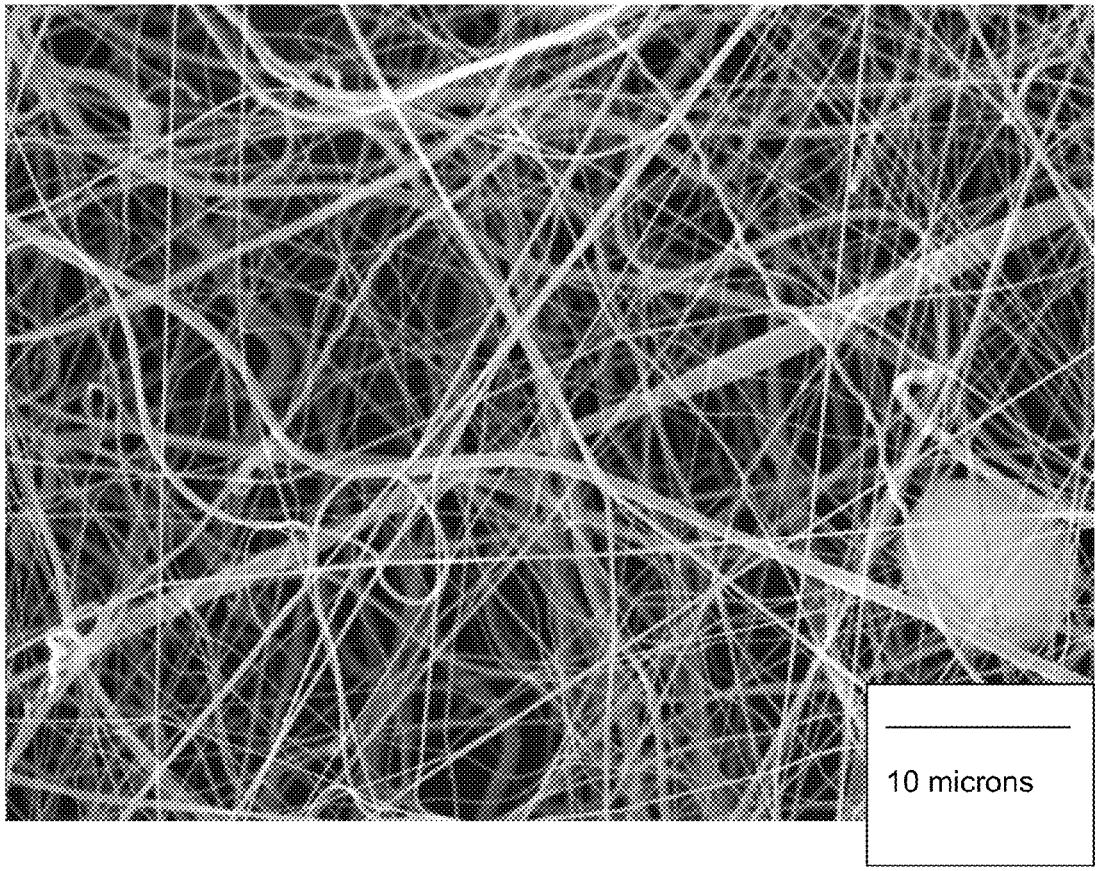
Figure 5c. SEM image of Nylon 6 fibers produced by electrospinning from a porous nozzle.

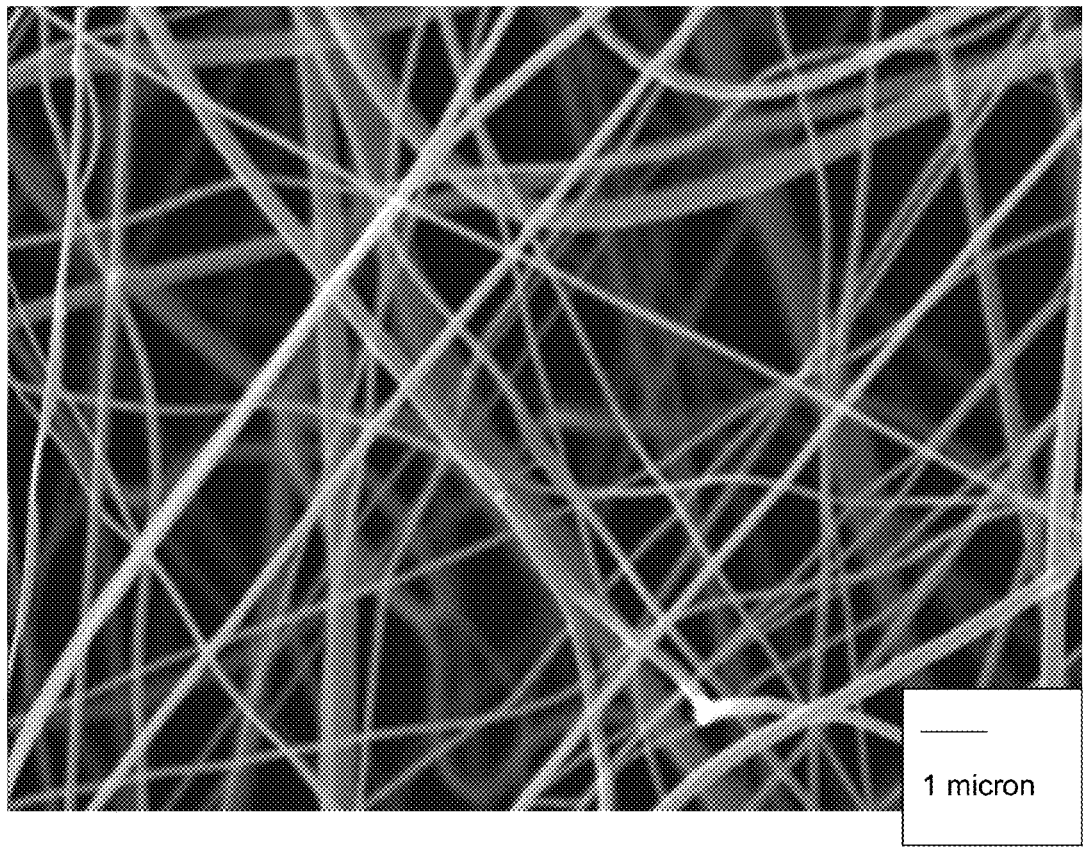
Figure 5d. SEM image of Nylon 6 fibers produced by electrospinning from a porous nozzle.

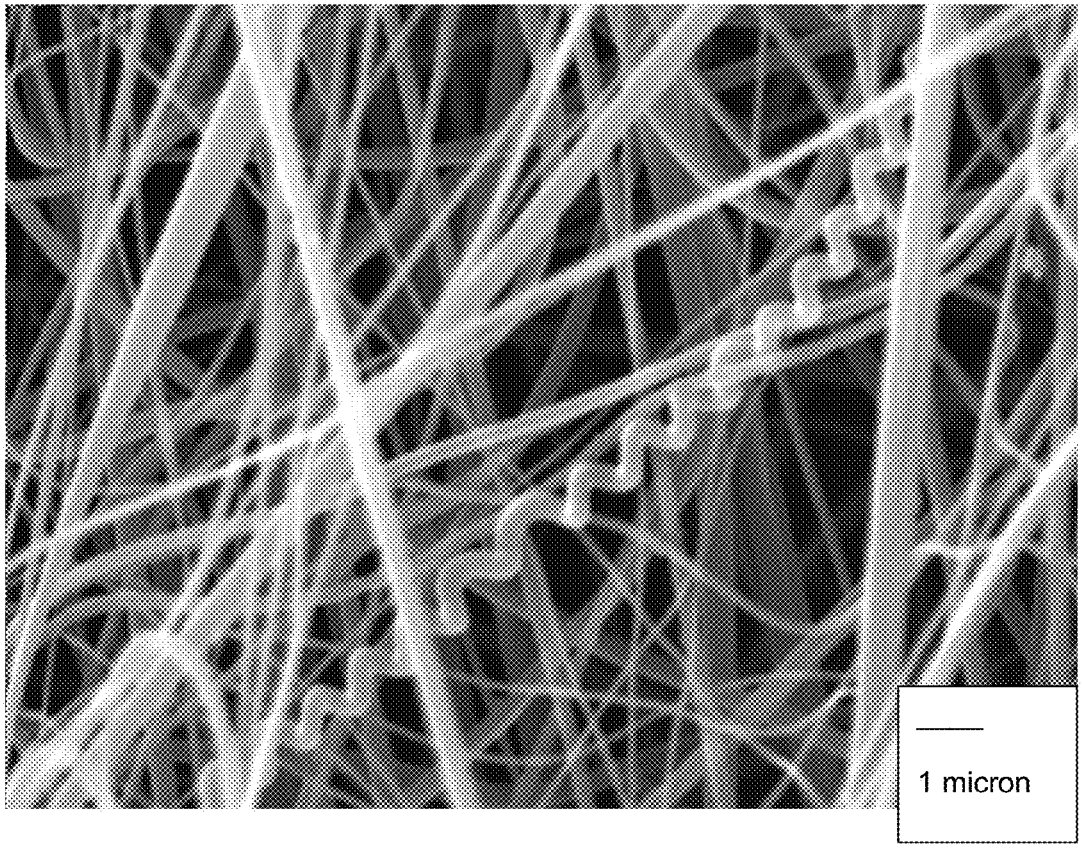
Figure 5e. SEM image of Nylon 6 fibers produced by electrospinning from a porous nozzle.

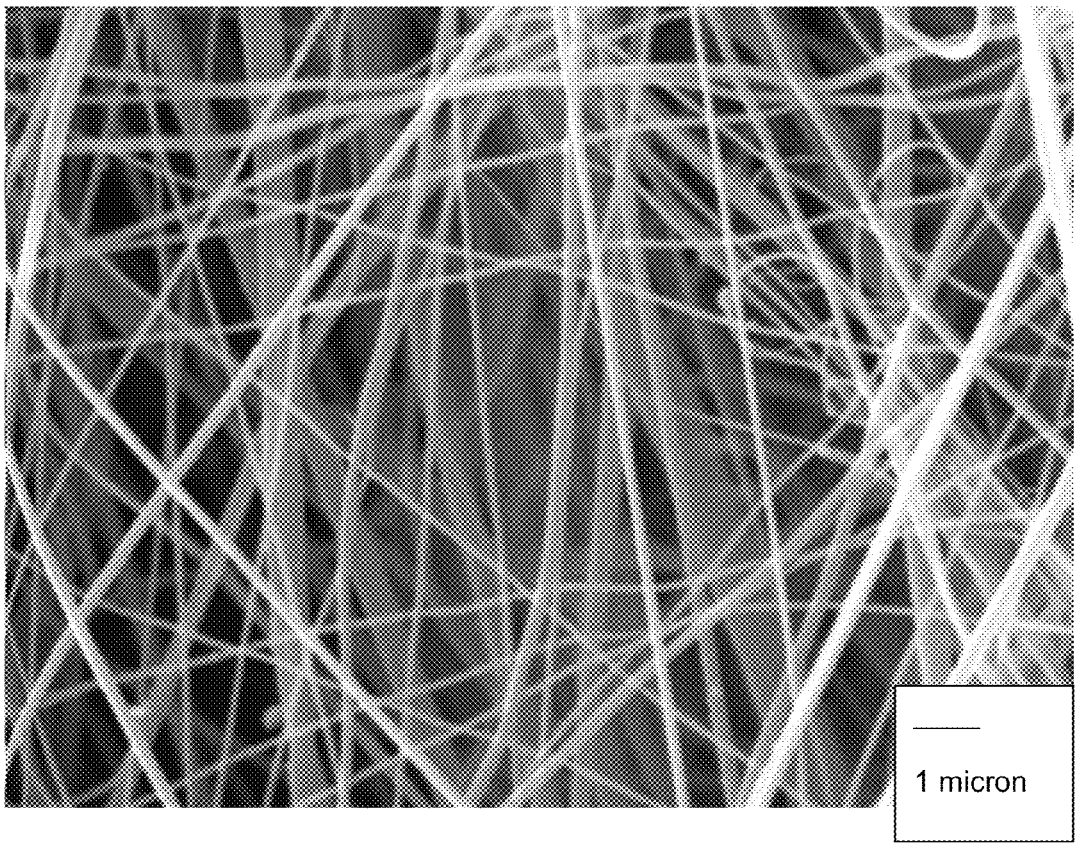
Figure 5f. SEM image of Nylon 6 fibers produced by electrospinning from a porous nozzle.

DEVICE FOR PRODUCING ELECTROSPUN FIBERS

RELATED FILINGS INFORMATION

This application is a Continuation-in-Part application of U.S. patent application Ser. No. 11/913,073, filed Apr. 28, 2008, now U.S. Pat. No. 7,959,848, which is a National Phase application under §371 of International Application No. PCT/US06/16961, filed May 3, 2006, which claims the benefit of U.S. Provisional Application Ser. No. 60/677,173, filed May 3, 2005.

FIELD OF THE INVENTION

The present invention relates to methods for producing fibers made from one or more polymers or polymer composites, and to structures that can be produced from such fibers. In one embodiment, the fibers of the present invention are nanofibers. The present invention also relates to apparatus for producing fibers made from one or more polymers or polymer composites, and methods by which such fibers are made.

BACKGROUND OF THE INVENTION

The demand for nanofibers and nanofiber technology has grown in the past few years. As a result, a reliable source for nanofibers, as well as economical methods to produce nanofibers, have been sought. Uses for nanofibers will grow with improved prospects for cost-efficient manufacturing, and the development of and/or expansion of significant markets for nanofibers is almost certain in the next few years. Currently, nanofibers are already being utilized in the high performance filter industry. In the biomaterials area, there is a strong industrial interest in the development of structures to support living cells (i.e., scaffolds for tissue engineering). The protective clothing and textile applications of nanofibers are of interest to the designers of sports wear, and to the military, since the high surface area per unit mass of nanofibers can provide a fairly comfortable garment with a useful level of protection against chemical and biological warfare agents. Also of interest is the use of nanofibers in the production of packaging, food preservation, medical, agricultural, batteries, electrical/semiconductor applications and fuel cell applications, just to name a few.

Carbon nanofibers are potentially useful in reinforced composites, as supports for catalysts in high temperature reactions, heat management, reinforcement of elastomers, filters for liquids and gases, and as a component of protective clothing. Nanofibers of carbon or polymer are likely to find applications in reinforced composites, substrates for enzymes and catalysts, applying pesticides to plants, textiles with improved comfort and protection, advanced filters for aerosols or particles with nanometer scale dimensions, aerospace thermal management application, and sensors with fast response times to changes in temperature and chemical environment. Ceramic nanofibers made from polymeric intermediates are likely to be useful as catalyst supports, reinforcing fibers for use at high temperatures, and for the construction of filters for hot, reactive gases and liquids.

Of interest is the ability to manufacture sufficient amounts of nanofibers, and if desirable, create products and/or structures that use and/or contained such fibers. Production of nanostructures by electrospinning from polymeric material has attracted much attention during the last few years. Although other production methods have been used to produce nanofibers, electrospinning is a simple and straightforward method of producing both nanofibers and/or nanostructures.

The nanostructures produced to date have ranged from simple unstructured fiber mats, wires, rods, belts, spirals and rings to carefully aligned tubes. The materials also vary from biomaterials to synthetic polymers. The applications of the nanostructures themselves are quite diverse. They include filter media, composite materials, biomedical applications (tissue engineering, scaffolds, bandages, drug release systems), protective clothing, micro- and optoelectronic devices, photonic crystals and flexible photocells.

Electrospinning, which does not depend upon mechanical contact, has proven advantageous, in several ways, to mechanical drawing for generating thin fibers. Although electrospinning was introduced by Formhals in 1934 (Formhals, A., "Process and Apparatus for Preparing Artificial Threads," U.S. Pat. No. 1,975,504, 1934), interest in the method was revived in the 1990s. Reneker (Reneker, D. H. and I. Chun, Nanometer Diameter Fibers of Polymer, Produced by Electrospinning, Nanotechnology, 7, 216 to 223, 1996) has demonstrated the fabrication of ultra thin fibers from a broad range of organic polymers.

Fibers are formed from electrospinning by uniaxial elongation of a viscoelastic jet of a polymer solution or melt. Up to 1993 the method was known as electrostatic spinning. The process uses an electric field to create one or more electrically charged jets of polymer solution from the surface of a fluid to a collector surface. A high voltage is applied to the polymer solution (or melt), which causes a charged jet of the solution to be drawn toward a grounded collector. The jet elongates and bends into coils as is reported in (1) Reneker, D. H., A. L. Yarin, H. Fong, and S. Koombhongse, *Bending Instability of Electrically Charged Liquid Jets of Polymer Solutions in Electrospinning*, J. Appl. Phys, 87, 4531, 2000; (2) Yarin, A. L., S. Koombhongse, and D. H. Reneker, *Bending Instability in Electrospinning of Nanofibers*," J. Appl. Phys, 89, 3018, 2001; and (3) Hohman, M. M., M. Shin, G. Rutledge, and M. P. Brenner, *Electrospinning and Electrically Forced Jets: II. Applications*, Phys. Fluids 13, 2221, 2001). The thin jet solidifies as the solvent evaporates, to form nanofibers with diameters in the submicron range that deposit on the grounded collector.

The viscoelastic jets are often derived from drops that are suspended at the tip of a needle, which is fed from a vessel filled with polymer solution. This arrangement typically produces a single jet and the mass rate of fiber deposition from a single jet is relatively slow (hundredths or tenths of grams per hour). To significantly increase the production rate of this design multiple jets from many needles are required. A multi-needle arrangement can be inconvenient due to its complexity. Yarin and Zussman (Yarin, A. L., E. Zussman, *Upward Needless Electrospinning of Multiple Nanofibers*, Polymer, 45, 2977 to 2980, 2004) report on an attempt to produce multiple jets using a layer of ferromagnetic suspension, under a magnetic field, beneath a layer of polymer solution in order to perturb the inter layer surface and consequently produce multiple jets on the surface. Yarin and Zussman also reported a potential of 12 fold increase in production rate over a comparable multi-needle arrangement. This arrangement is quite complex and a continuous operation will be a challenge. Therefore, a simpler approach is desired that would permit, among other things, the increased production of fibers and/or nanofibers.

To that end, the present invention provides nozzle structures useful for providing multiple jets for producing the nanofibers. These jets are formed at pores formed in a main nozzle body. Because in many applications these pores are very small, typically in the micron range, it is often very difficult to form the desired pores in the main nozzle body. Although drill bits exist having diameters in the micron range, there are also typically quite short, and often are not long enough to drill through the wall thickness of the nozzle body. Additionally, they break easily and can be quite expensive. Pores might also be formed in the nozzle body through laser cutting, but laser cutting methods are very expensive, as well. Thus, the present invention seeks not only to provide nozzles that can increase the rate of production of fibers and/or nanofibers, but also provides new means for forming the desired pores at which the fiber jets emanate from the nozzle.

SUMMARY OF THE INVENTION

The present invention relates to nozzles, apparatus and methods for electrospinning fibers made from one or more polymers or polymer composites. In one embodiment, the fibers of the present invention are nanofibers.

In one embodiment, this invention relates to an electrospinning nozzle comprising a nozzle body having a hole therein, and a film covering the hole and providing a spinning pore aligned with the hole, the spinning pore being smaller in cross-section than the hole. The hole can be machined or otherwise included in the nozzle body, and, if machined, may be formed using less expensive devices and techniques because the hole need not be of the micro-scale dimension typically desired for spinning pores. Instead, the spinning pore provided in the film will be of the desired dimensions, and the spinning pore can be formed through less expensive techniques.

In one or more other embodiments, this invention provides an electrospinning nozzle comprising a nozzle body having a hole therein, and a conductive tube secured at said hole, said conductive tube providing a liquid pathway fluidly communicating with said hole and leading to a spinning pore at the distal end of said conductive tube.

In yet one or more other embodiments, this invention provides an electrospinning apparatus comprising: a 3-dimensional collector having a plurality of walls; a nozzle body holding fiber-forming media, said nozzle body providing an exterior surface selected from a circular surface and a semi-spherical surface; and a plurality of spinning pores fluidly communicating with said fiber-forming media through said nozzle body at different locations about said exterior surface, wherein fiber jets emanate from said spinning pores to extend in various directions toward the plurality of walls of the 3-dimensional collector.

In still another embodiment, this invention provides an electrospinning nozzle comprising: a tubular nozzle body having an inner tubular surface for holding fiber-forming media; and a conductive spring having a flat cross section and being secured at its outer circumference to said inner surface of said tubular nozzle body, whereby said conductive spring serves as an electrode to charge fiber-forming media within said tubular nozzle body and further serves to define a continuous shelf and catch for fiber-forming media forced into and through said tubular nozzle body.

BRIEF DESCRIPTION OF THE DRAWINGS

FIG. 1 is a cross-section schematic diagram of an apparatus for electrospinning fibers, nanofibers, and/or fiber or nanofiber structures according to the present invention;

FIGS. 2*a* and 2*b* are schematic drawings of two types of collectors utilized to collected fibers and/or nanofibers produced in accordance with the present invention;

FIGS. 4*a* to 4*h* are photographs of a porous cylindrical nozzle for use in the production of fibers and/or nanofibers according to the present invention. The nozzles of FIGS. 3*a* to 3*h* are used in conjunction with a wire mesh collector;

FIGS. 5*a* to 5*f* are photographs of nanofibers produced using a method in accordance with the present invention;

DETAILED DESCRIPTION OF ILLUSTRATIVE EMBODIMENTS

Figure 3A:
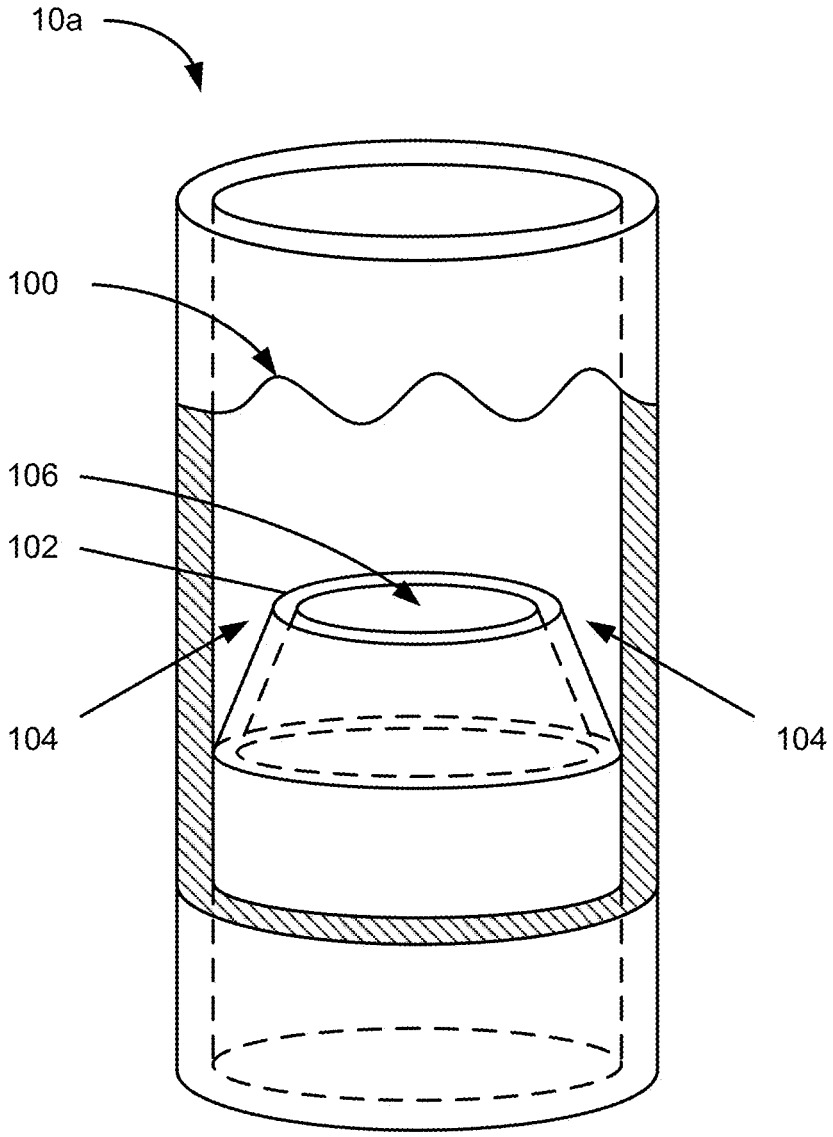
FIGS. 3*a* to 3*c* are schematic illustrations of alternative embodiments for a nozzle utilized in conjunction with the present invention.

As used herein nanofibers are fibers having an average diameter in the range of about 1 nanometer to about 25,000 nanometers (25 microns). In another embodiment, the nanofibers of the present invention are fibers having an average diameter in the range of about 1 nanometer to about 10,000 nanometers, or about 1 nanometer to about 5,000 nanometers, or about 3 nanometers to about 3,000 nanometers, or about 7 nanometers to about 1,000 nanometers, or even about 10 nanometers to about 500 nanometers. In another embodiment, the nanofibers of the present invention are fibers having an average diameter of less than 25,000 nanometers, or less than 10,000 nanometers, or even less than 5,000 nanometers. In still another embodiment, the nanofibers of the present invention are fibers having an average diameter of less than 3,000 nanometers, or less than about 1,000 nanometers, or even less than about 500 nanometers. Additionally, it should be noted that here, as well as elsewhere in the text, ranges may be combined.

As is noted above, the present invention relates to nozzles, apparatus and methods for producing fibers made from one or more polymers or polymer composites. In one embodiment, the fibers of the present invention are nanofibers. In one embodiment, the present invention relates to a method and apparatus designed to produce fibers and/or nanofibers at an increased rate of speed. In one instance, the apparatus of the present invention utilizes an appropriately shaped porous structure, in conjunction with a liquid fiber-producing media (or fiber-forming liquid), to produce fibers and/or nanofibers.

As is illustrated in FIG. 1, in one embodiment an electrospinning apparatus according to present invention utilizes a cylindrically-shaped porous nozzle 10 to produce the desired fibers and/or nanofibers. Although not illustrated in FIG. 1, nozzle 10 is connected via any suitable means to a supply of liquid media/fiber-forming liquid from which the desired fibers are to be produced. The liquid media is supplied usually under pressure via, for example, a pump to nozzle 10. Although other supply systems could be used depending upon the type of liquid fiber-producing media being used (or the fiber-forming media's chemical and/or physical properties).

The pressure at which the liquid fiber-producing media is supplied to nozzle 10 depends, in part, upon the type of liquid material that is being used to produce the desired fibers. For example, if the liquid media has a relatively high viscosity, more pressure may be necessary to push the liquid media through the spinning pores of nozzle 10 in order to produce the desired fibers. In another embodiment, if the liquid media has a relatively low viscosity (about the same as, lower than, or slightly higher than that of water), less pressure may be needed to push the liquid media through the spinning pores of nozzle 10 in order to produce the desired fibers. Accordingly, the present invention is not limited to a certain range of pressures. Notably, as used herein, "spinning pore" is to connote an aperture suitable for creating the liquid droplet necessary for generating the Taylor cone from which the jet of fiber-forming liquid emanates.

Any compound or composite compound (i.e., any mixture, emulsion, suspension, etc. of two or more compounds) that can be liquefied can be used as the fiber-forming liquid to form fibers and/or nanofibers in accordance with the present invention. Such compounds and/or composites include, but are not limited to, molten pitch, polymer solutions, polymer melts, polymers that are precursors to ceramics, molten glassy materials, and suitable mixtures thereof. Some exemplary polymers include, but are not limited to, nylons, fluoropolymers, polyolefins, polyimides, polyesters, polycaprolactones, and other engineering polymers, or textile forming polymers.

In the embodiment where a polymer compound or composite is being used to form the liquid media of the present invention, generally speaking a pressure of less than about 5 psig can be used to push the liquid media through the pores of nozzle 10. Although, as stated above, the present invention is not limited to only pressures of 5 psig or less. Rather, any suitable pressure can be utilized depending upon the type of liquid media being pushed/pumped/supplied to nozzle 10.

Nozzle 10 is made from any suitable material taking into consideration the compound or composite compound that is being used, or that is going to be used, to produce fibers in accordance with the present invention. Accordingly, there are no limitations on the compound or compounds used to form nozzle 10, the only necessary feature for nozzle 10 is that the nozzle be able to withstand the process conditions necessary to liquefy the compound or composite compound that is being used to produce the fibers of the present invention. Accordingly, nozzle 10 can be formed from any material, including, but not limited to, a ceramic compound, a metal or metallic alloy, or a polymer/co-polymer compound. As noted above, in one embodiment nozzle 10 is porous. In another embodiment, nozzle 10 can be made from a solid material that has spinning pores machined therein. These spinning pores can be arranged in any pattern, be the pattern regular or irregular. For example, nozzle 10 could be formed by joining together two cylinders, each made from a mesh screen together, with each mesh screen independently having a regular or irregular pattern of holes formed therein. By varying the patterns and/or the distance between the two mesh cylinders, any number of hybrid spinning pores can be formed. For example, by off-setting two cylindrical screens having circular hybrid spinning pores therein, it is possible to form a nozzle 10 with elliptically-shaped through bores serving as spinning pores. Given the above, the present invention is not limited to any one spinning pore pattern or geometry, rather any desired spinning pore pattern or geometry can be used.

In still another embodiment, nozzle 10 can be formed from a porous material inherently containing one or more spinning pores therethrough to communicate with fiber-forming liquid. Alternatively, with a nozzle 10 of porous material, the spinning pores formed in nozzle 10 do not necessarily have to be formed completely through the wall(s) of nozzle 10. Instead, partial indents can be formed on the exterior and/or interior surfaces of nozzle 10 by any suitable means (e.g., drilling, casting, punching, etc.). Because the nozzle is made of a porous material, the fiber-forming media can be forced therethrough if placed under sufficient pressure. The indents provided in a porous nozzle reduce the resistance to flow and thus, fiber-forming media can be delivered to the indents at a pressure that is sufficient for feeding the fiber-forming media to the indents, but not sufficient for forcing the fiber-forming media through the porous nozzle at locations other than the indents. In this case, the partial indents formed on one or more surfaces of nozzle 10 lower the resistance to fiber forming in the areas of nozzle 10 around any such partial indents. As such, greater control over the fiber formation process can be obtained.

The size of the spinning pores formed in nozzle 10 is not critical. While not wishing to be bound to any one theory, it should be noted that the size of the spinning pores in nozzle 10 have, in one embodiment, minimal impact upon the size of the fibers produced in accordance with the present invention. Instead, in one instance, fiber size is controlled by a combination of factors that include, but are not limited to, (1) the size of one or more droplets that form on the outside surface of nozzle 10 (at the spinning pores or partial indents) that give "birth" to the jets of fiber-forming liquid; (2) the pressure of the fiber-forming media inside nozzle 10; (3) the existence and size of any internal structures within and/or on the interior of nozzle 10, as will be discussed in detail below; and (4) the amount, if any, of fiber-forming liquid that is re-circulated from the interior of nozzle 10 and the pressure associated with any such recirculation.

In one embodiment, nozzle 10 is formed from a polypropylene rod having pores therein ranging in size from about 10 to about 20 microns. However, as noted above, the present invention is not limited thereto. Rather, as noted above, any porous material that is unaffected by the fluid to be used for fiber production can be used without affecting the result (e.g., porous metal nozzles). The number of spinning pores in nozzle 10 is not critical; any number of spinning pores can be formed in nozzle 10 depending upon the desired rate of fiber production. In one embodiment, nozzle 10 has at least about 10 spinning pores, at least about 100 spinning pores, at least about 1,000 spinning pores, at least about 10,000 spinning pores, or even less than about 100,000 spinning pores. In still another embodiment, nozzle 10 has at less than about 20 spinning pores, less than about 100 spinning pores, less than about 1,000 spinning pores, or even less than about 10,000 spinning pores.

With reference again to FIG. 1, the size of nozzle 10 is not critical. As shown in the embodiment of FIG. 1, nozzle 10 has an inner diameter of 1.27 cm and a height of 5 cm. However, nozzle 10 is not limited to only the dimensions disclosed in FIG. 1. Rather, any size nozzle can be used in the apparatus of the present invention depending upon such factors as desired fiber diameter, fiber length, fiber compound/composite, and/or fiber-containing structure that is being produced.

Also included in the apparatus of FIG. 1 is an electrode 20 that is positioned to input an electrical charge to the fiber-forming liquid fed to the nozzle. As one option, when the nozzle is electronically conductive, the electrode 20 can be placed in electrical contact with nozzle 10. As is illustrated in FIG. 1, electrode 20 is placed on and partially through the bottom surface of nozzle 10. However, the present invention is not limited to solely the arrangement shown in FIG. 1. Rather, any other suitable arrangement that permits electrical connectivity between nozzle 10 and electrode 20 can be used. As would be apparent to those of skill in the art, electrode 20 provides to nozzle 10 (and in effect the fiber-forming liquid contained therein) the electrical charge necessary to form fibers and/or nanofibers by an electrospinning process. As another option, the electrode can input the charge directly to the fiber-forming liquid, particularly when the nozzle is non-conductive.

Upon application of a charge to the desired fiber-forming liquid, the fibers produced in the apparatus of FIG. 1 are attracted to collector 30. Generally, collector 30 is grounded, thereby promoting the electrical attraction between the charged fiber-forming structures emanating from the one or more pores of nozzle 10 and collector 30. Although, in this embodiment, collector 30 is shown as a cylinder-shaped collector, the present invention is not limited thereto. Any shape collector can be utilized. For example, as is shown in FIG. 2, alternative collectors 40*a* and 40*b* can be formed in the shape of a curved belt 40*a* or a sheet 40*b*. Additionally, the collector of the present invention can be stationary or movable. In the case where the collector is movable, the fibers formed in accordance with the present invention can be more easily produced on a continuous basis. Again, the size of collector 30 is not critical. Any size collector can be used depending upon the size of nozzle 10, the diameter and/or length of fibers to be produced, and/or other process parameters. As is shown in FIG. 2, nozzle 10 can also be an elongated tubular or a spherical-shaped nozzle. Again, the shape of nozzle 10 is not limited to shapes disclosed herein. Rather, nozzle 10 can be any desired 3-dimensional shape.

The diameter of the fibers of the present invention can be adjusted by controlling various conditions including, but not limited to, the size of the spinning pores in nozzle 10 and the specific properties of the fiber-forming media. The length of these fibers can vary widely to include fibers that are as short as about 0.0001 mm up to those fibers that are about many km in length. Within this range, the fibers can have a length from about 1 mm to about 1 km, or even from about 1 mm to about 1 cm.

In another embodiment, nozzle 10 can include one or more interior cones, shelves, or lips formed on and/or attached to the interior surface of nozzle 10. As shown in cut-away section 100 of FIG. 3*a*, nozzle 10*a* includes a cone 102 that is connected and/or mounted within the interior of nozzle 10. Cone 102 forms a catch 104 that is designed to collect fiber forming media/material thereon. Once catch 104 becomes full the fiber forming material (not shown) will overflow through opening 106 in cone 102 and drip down towards the bottom of nozzle 10*a*, which is similar in structure to the bottom of nozzle 10. In another embodiment, as is shown in FIG. 3*b*, nozzle 10*b* has two of more cones 102 formed in the interior thereof. Although embodiments with one or two interior cones are shown, the present invention is not limited thereto. Instead, any number of cones, shelves or lips can be used in conjunction with nozzles 10, 10*a*, or 10*c*.

Figure 3B:
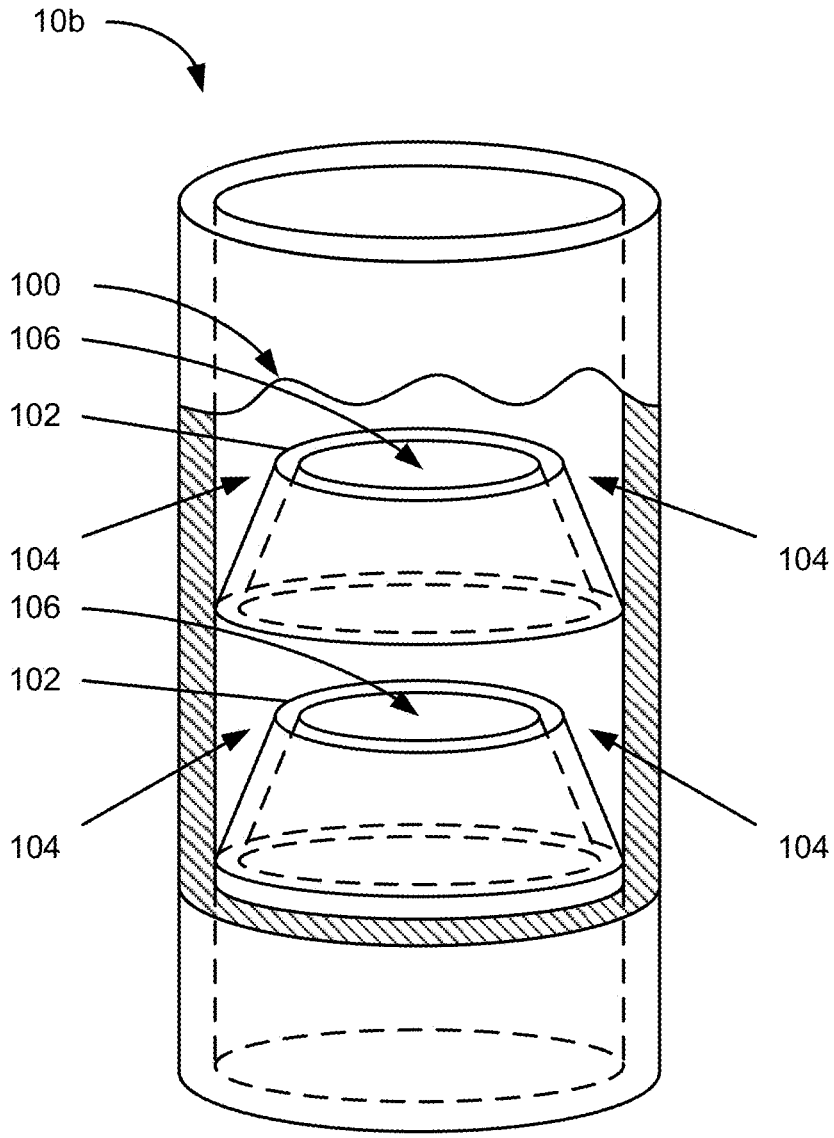
Figure 3C:
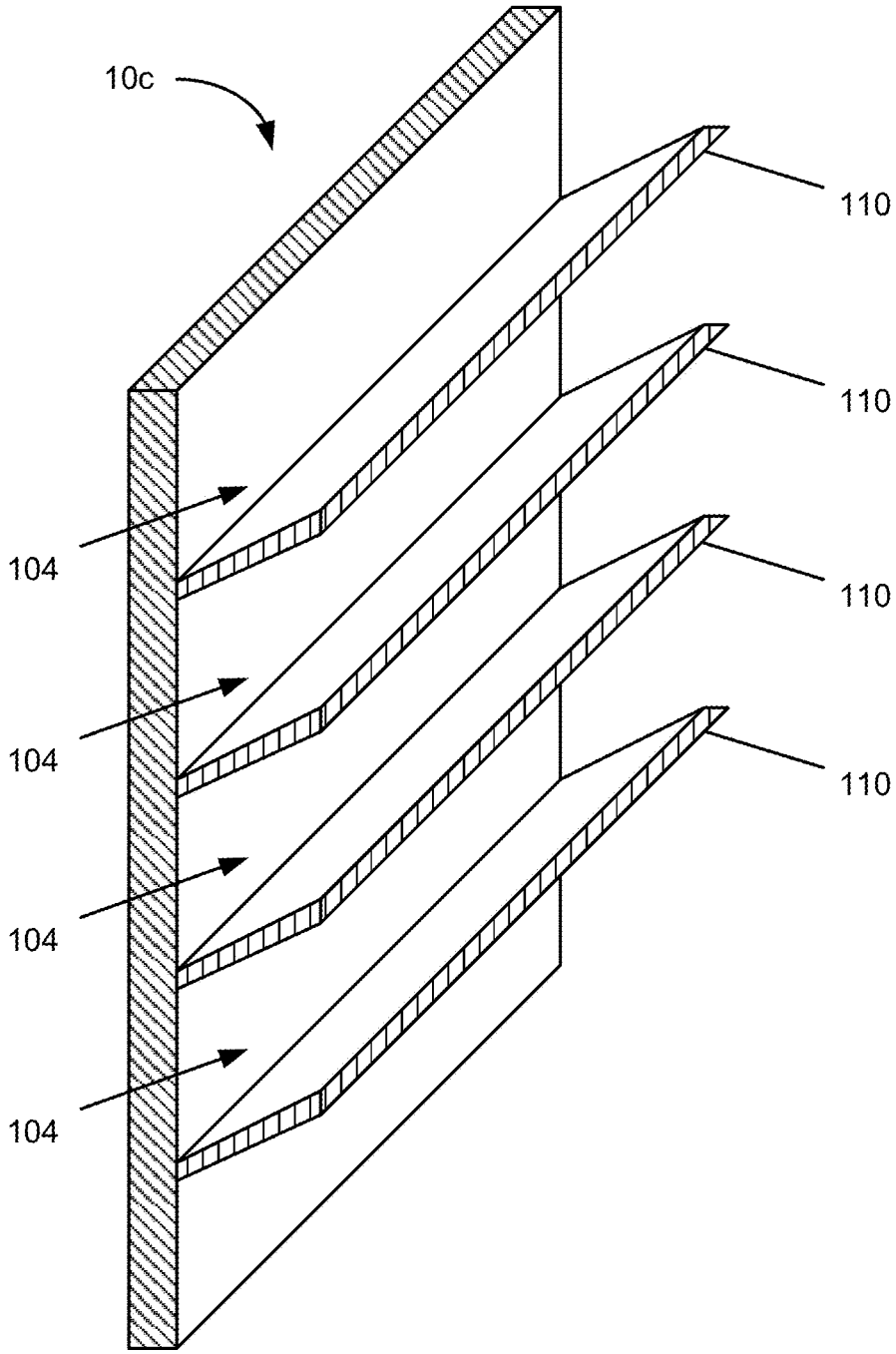

Turning to FIG. 3*c*, one side of a three dimensionally-shaped polygon nozzle 10*c* is shown. In this embodiment, nozzle 10*c* has at least three sides (i.e. a nozzle having a triangular cross-section). As would be appreciated by those of skill in the art, in this embodiment nozzle 10*c* can have a polygonal cross-sectional shape with the number of sides being any number greater than 3. In the embodiment of FIG. 3*c*, at least one shelf 110 is formed on one or more interior surfaces of nozzle 10*c* and each shelf 110 is able to hold fiber forming media and/or liquid in one or more catches 104. In one embodiment, each shelf 110 is continuously formed on all the interior surfaces of nozzle 10*c*. That is, in this embodiment each shelf 110 is a polygon-shaped "cone" similar to cones 102 of FIGS. 3*a* and 3*b*. Although FIG. 3*c* illustrates an embodiment with four interior shelves, the present invention is not limited thereto. Instead, any number of cones, shelves or lips can be used in conjunction with nozzle 10*c*.

Figure 11:
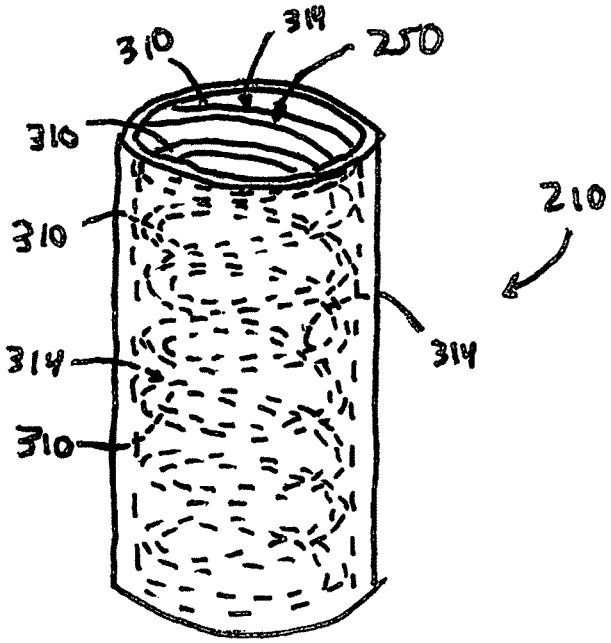
FIG. 11 is a schematic perspective view of a nozzle in accordance with this invention, wherein a coil spring is employed to create shelves and catches therein.

In still another embodiment, a coiled wire or spring is inserted in the interior of nozzles 10, 10*a*, 10*b* or 10*c* (not shown). This is schematically shown in FIG. 11, in a nozzle 210. The nozzle 210 is tubular, but can take other shapes. The nozzle 210 has a coiled spring 250 therein that is secured at its outer circumference to the inner surface of the wall of the nozzle 210 such that the spring 250 creates the aforementioned shelves and catches, here numbered as shelves 310 and catches 304. In particular embodiments, the spring 250 has a flat cross section so that he coils provide well-defined flat shelves. By making the spring 250 of conductive material, it can also serve as the electrode, such as electrode 20.

It will be appreciated that, as mentioned in the Background herein, it is often difficult to cost-effectively form the microscopic spinning pores necessary for electrospinning fibers of microscopic diameter. Thus, turning to FIG. 6, a nozzle is shown for forming spinning pores in an electrospinning nozzle 10*d*. Nozzle 10*d* includes a nozzle body 12*d*, which, in the embodiment shown, is tubular, although it will be readily appreciated and is expressly noted herein that the nozzle body may take any suitable form for receiving fiber-forming liquid. Indeed, the nozzle body 12*d* may be merely a flat plate in some embodiments. If the nozzle body 12*d* is formed of electrically conductive material, an electrode 20*d* can be attached to the nozzle body 12*d* in order to charge the fiber-forming liquid fed therethrough. If the nozzle body 12*d* is non-conductive the electrode can otherwise be positioned to contact and charge the fiber-forming liquid, as known. The nozzle body 12*d* includes a hole 14*d* therein. Hole 14*d* is formed through the nozzle body 12*d* by any suitable means. Hole 14*d* is too large in diameter for serving as a suitable spinning pore for the nozzle 10*d*. Thus, to provide a suitable spinning pore, a film 16*d* covers the hole 14*d* and provides a spinning pore 18*d* of suitable dimensions for creating the desired jet, the spinning pore 18*d* being aligned with the hole 14*d* in the nozzle body 12*d*. The hole 14*d* is necessarily larger than the spinning pore 18*d*. The hole 14*d* can be a naturally occurring hole, as might be the case if the nozzle body 12*d* is formed of a porous material (e.g., polymer foams) or the hole 14*d* may be machined into and through the nozzle body 12*d* by any suitable means, which may include lasers or drills and the like.

In one or more embodiments, the nozzle body 12*d* has a wall thickness greater than 100 microns. In one or more other embodiments, the nozzle body 12*d* has a thickness greater than 1 mm, in other embodiments greater than 2 mm, in yet other embodiments greater than 5 mm, and in yet other embodiments greater than 10 mm. It will be appreciated that drills suitable for providing spinning pores will typically have a diameter of from 20 microns to 1000 microns, and often from 50 to 100 microns, but will only have a length of from 20 to 100 microns, such that, with a nozzle body 12*d* of greater than 100 microns, such drill bits would not be suitable for directly forming spinning pores through the nozzle body 12*d*. Thus, by employing a nozzle constructed as is nozzle 10*d*, it is possible to drill larger holes through the nozzle body 12*d*, using more standard drill bits, and the desired smaller spinning pore 18*d* can be readily formed through the thin film.

In one or more embodiments, the hole 14*d* is greater than 1 mm in diameter. In one or more other embodiments, the hole 14*d* is greater than 2 mm in diameter, in other embodiments, greater than 3 mm in diameter, and in yet other embodiments, greater than 5 mm in diameter. Similarly, in one or more embodiments, the hole 14*d* is less than 5 mm in diameter. In one or more other embodiments, the hole 14*d* is less than 3 mm in diameter, in other embodiments, less than 2 mm in diameter, and in yet other embodiments, less than 1 mm in diameter. In one or more embodiments, the spinning pore 18*d* is greater than 10 microns in diameter. In one or more other embodiments, the spinning pore 18*d* is greater than 20 microns in diameter, in other embodiments, greater than 50 microns in diameter, and in yet other embodiments, greater than 100 microns. Similarly, in one or more embodiments, the spinning pore 18*d* is less than 500 microns in diameter. In one or more other embodiments, the spinning pore 18*d* is less than 200 microns in diameter, in other embodiments, less than 100 microns in diameter, and in yet other embodiments, less than 50 microns.

The film 16*d* may be selected from virtually any film that will not be affected by the electrospinning conditions and/or the fiber-forming liquid that will come into contact with the film 16*d*. In particular embodiments, the film 16*d* is selected from tapes (such as acrylic tape), polymer films (such as polyvinylchloride, polymethylmethacrylate and nylon), metallic films (such as copper, aluminum, and steel alloys), coatings (such as latex and polyurethane), and composites of different polymer films or polymers and metals. The film will typically be chosen to have a thickness of from 20 to 500 microns.

In a particular embodiment, a PVC tubular nozzle is 1 meter long and 2.5 cm in diameter, with 3 mm thick walls. It is fabricated with 200 holes, each 200 mm in diameter and covered with acrylic tape having spinning pores drilled therethrough having a diameter of 200 microns.

Figure 6:
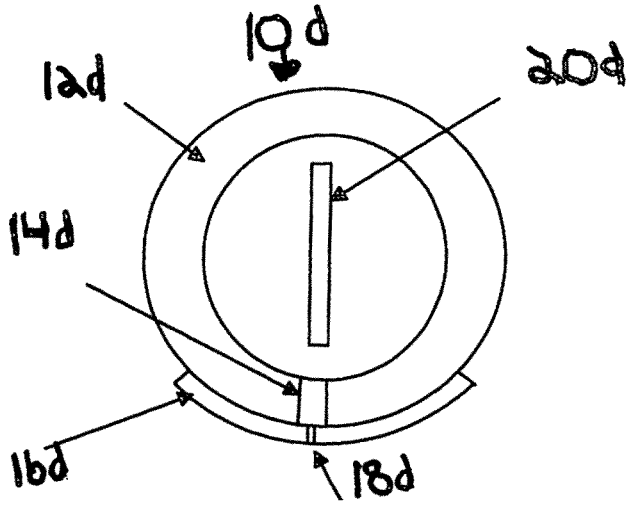
FIG. 6 is a cross-section schematic diagram of a nozzle for producing fibers, nanofibers and/or fiber or nanofibers structures, wherein a spinning pore is provided by a film.

Though FIG. 6 shows one exemplary hole 14*d* and spinning pore 18*d*, it will be readily appreciated that the concept of providing a spinning pore in a film can be practiced to provide any number of desired spinning pores in nozzles of various forms. Although not shown, it should be appreciated that the various interior cone, shells or lip structures disclosed with respect to FIGS. 3*a*, 3*b* and 3*c* can be incorporated into suitable nozzle structures made in accordance with FIG. 6.

It should be appreciated from the foregoing disclosure that the nozzle of FIG. 6 can be more cost-efficiently produced than is typically experienced with common electrospinning nozzles inasmuch as the holes can be machined into the nozzle body (if not inherently existent) using common, inexpensive devices and processes, whereas creating spinning pores of small dimension directly through a nozzle body can require very expensive devices and processes (e.g., expensive micro drills or laser techniques).

Figure 7:
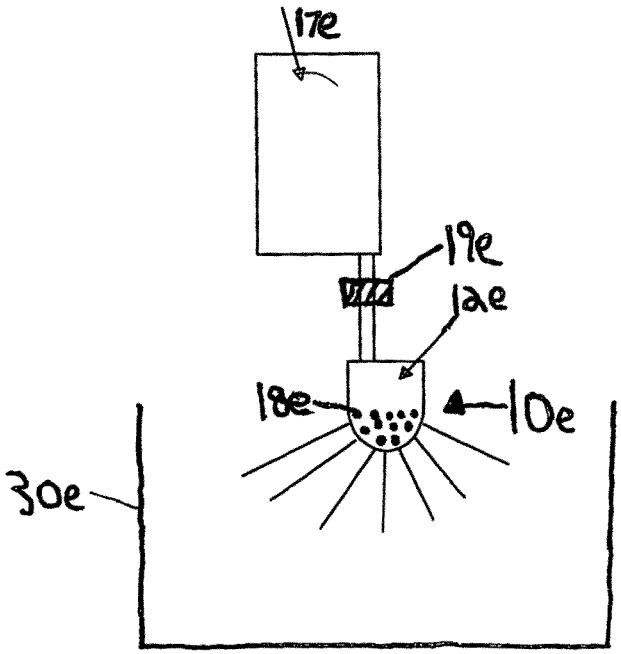
FIG. 7 is a general schematic diagram of an apparatus for electrospinning fibers, nanofibers and/or fiber or nanofiber structures, wherein the apparatus employs a 3-dimensional collector and a hemispherical nozzle.
Figure 8:
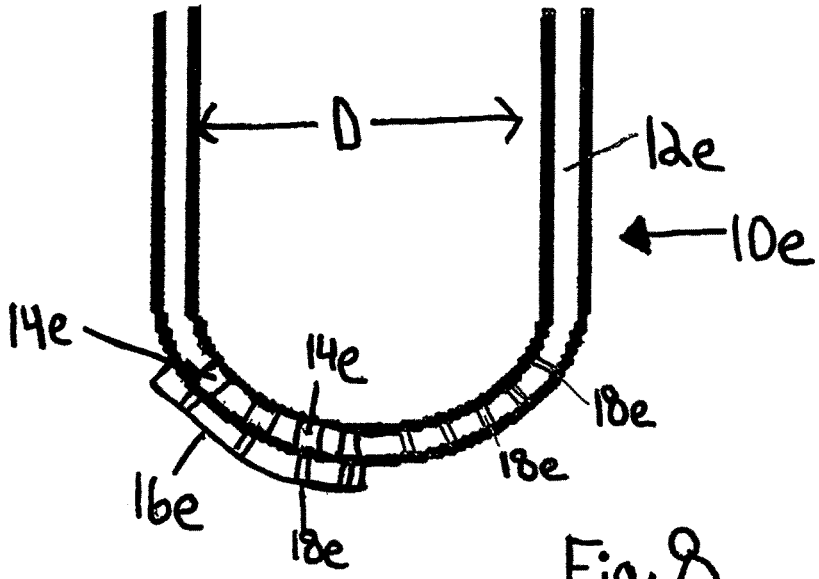
FIG. 8 is a cross-sectional schematic diagram of a hemispherical nozzle as in FIG. 7.
Figure 9:
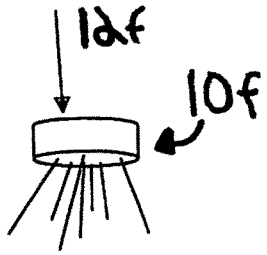
FIG. 9 is a general schematic view of a nozzle having a disc design.

With the understanding that it may be preferred, at times, to have all of the jets produced by the electrospinning nozzle confined in one general area, the present invention proposes a hemispherical nozzle design in FIGS. 7 and 8, and a disc nozzle design, in FIG. 9. These designs will be particularly useful when the collector is provided with a 3-dimensional shape, as opposed to the purely linear or planar structure of a belt-type or flat plate collector. By "3-dimensional" it is broadly meant that the collector has a shape outside of planar. In particular embodiments, the 3-dimensional collector has a volume defining shape, which, in specific embodiments is box-shaped, cylindrical or conical/funnel shaped.

With reference to FIGS. 7 and 8, a hemispherical nozzle 10*e* is shown having a nozzle body 12*e* with spinning pores 18*e* formed therein along all or a portion of the hemispherical surface defined by body 12*e*. In FIG. 7, some jet lines are drawn emanating from the peripheral spinning pores 18*e*, while other of the pores 18*e* are simply shown without any jets emanating therefrom. Though the spinning pores 18*e* are shown extending directly through the body 12*e*, it is also possible to provide spinning pores 18*e* by practicing the concept of FIG. 6 of employing a film to provide the spinning pores. This is shown on the left portion of the nozzle body 12*e* shown in FIG. 8, wherein a film 16*e* covers holes 14*e* and provides spinning pores 18*e*, substantially as the film 16*d* and holes 14*d* in the embodiment of FIG. 6. With specific reference to FIG. 7, it can be seen that a fiber-forming liquid reservoir is provided at 17*e* to feed fiber-forming liquid to the nozzle 10*e*. A 3-dimensionally shaped collector 30*e* is provided surrounding the nozzle 12*e* so as to collect electrospun fibers jetting out from the nozzle 10*e*. The fiber-forming liquid would be charged, while the collector would be grounded, or vice-versa. A pump, generally represented at 19*e*, could be provided to advance the fiber-forming liquid to the nozzle 10*e*. Alternatively, the solution reservoir 17*e* could be pressurized to provide the pressure needed for the polymer solution to flow through the spinning pores. It should be appreciated that the "3-dimensional" collector is described as such to distinguish it from a mere flat plate (or planar structure), but such a planar structure could be employed. It is merely a specific focus of the hemispherical nozzle to help cover an area with the jets collecting in a circular pattern. With the 3-dimensional collector, the fibers can be spun in a radial, even semi-spherical patter, with jets extending in various directions toward the various walls of the 3-dimensional collector.

In a particular embodiment, the hemispherical nozzle 10*e* has a nozzle body 12*e* constructed of polyvinyl chloride (PVC) and has an inner diameter D (see FIG. 8) of from about 5 cm to 15 cm. The holes 14*e* or spinning pores 18*e* (according to which construct is practiced) can be provided through the body 12*e* in various patterns on the rounded surface. The number of holes 14*e* or spinning pores 18*e* can vary from 1 to about 1000 or even more, with the holes typically being spaced from about 0.5 to 2 cm apart.

In a particular embodiment, a PVC hemisphere nozzle is 7 cm in diameter, is formed of walls that are 5 mm thick, and has 24 pores that are 200 microns in diameter randomly distributed over the surface.

As an alternative to the hemispherical nozzle 10*e*, a disc-shaped nozzle 10*f* may be practiced, as at FIG. 9, with a multitude of holes or spinning pores (according to the construct desired) being formed in the bottom circular surface of a disc-shaped nozzle body 12*f* so that a circular pattern can be formed by the electrospun fibers. If desired, the disc-shaped nozzle 12*f* can be made with the film concept of FIG. 6.

Although not shown, it should be appreciated that the various interior cone, shells or lip structures disclosed with respect to FIGS. 3*a*, 3*b* and 3*c* can be incorporated into suitable nozzle structures made in accordance with FIGS. 7-9. As has been disclosed a number of times above, the nozzle body in any of the various embodiments herein maybe electrically conductive or non-conductive. When electrically conductive, the electrode 20 is typically secured the nozzle body to charge the same and thereby charge the fiber-forming liquid passing therethrough. However, when the conductive nozzle body is charged and is of a large surface area, there is a potential that an operator could be shocked by coming too close to the nozzle body. Additionally, the charge can be difficult to control and can sometimes cause damage to other electrical components. Thus, in many embodiments it may be preferable to employ a non-conducting nozzle body.

Figure 10:
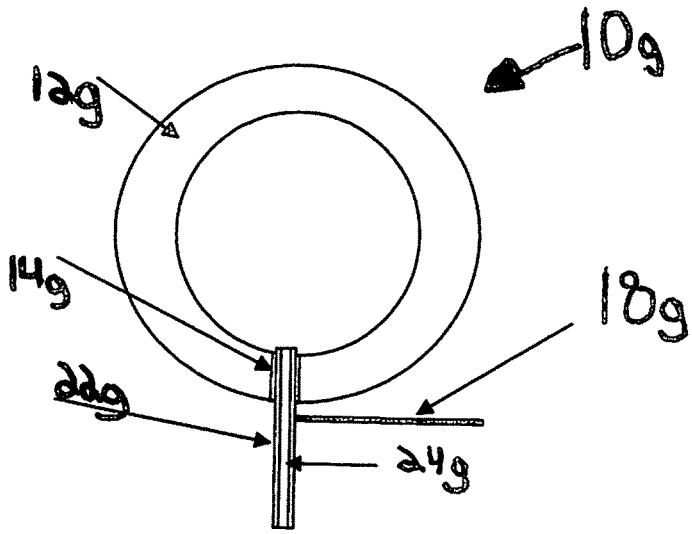
FIG. 10 is a cross-sectional schematic diagram of a nozzle for electrospinning fibers, nanofibers, and/or fiber or nanofiber structures, wherein a spinning pore is formed through the use of a conductive tube.

Referring now to FIG. 10, yet another nozzle construct is provided, one in which the nozzle body need not be conductive. In FIG. 10, a nozzle 10*g* has a nozzle body 12*g*, which, in the embodiment shown, is tubular, although it will be readily appreciated and is expressly noted herein that the nozzle body 12*g* may take any suitable form for receiving fiber-forming liquid. Indeed, the nozzle body 12*g* may be merely a flat plate in some embodiments. The nozzle body 12*g* includes a hole 14*g* therein. Hole 14*g* is formed through the nozzle body 12*g* by any suitable means. Hole 14*g* is too large in diameter for serving as a suitable spinning pore for the nozzle 10*g*. Thus, to provide a suitable spinning pore, a conductive tube 22*g* is securely fit into or around the hole 14*g* to provide a liquid pathway 24*g* that terminates in a spinning pore 18*g* of suitable dimensions for creating the desired jet. The hole 14*g* is necessarily larger than the spinning pore 18*g*. The hole 14*g* can be a naturally occurring hole, as might be the case if the nozzle body 12*g* is formed of a porous material (e.g., polymer foams) or the hole 14*g* may be machined into and through the nozzle body 12*g* by any suitable means, which may include lasers or drills and the like. The conductive tube 22*g* can be welded, adhered or other wise suitable secured to the hole 14*g*. The interior diameter of the conductive tube 22*g* may range from 20 microns to 1 mm to provide suitable jets. The conductive tube 22*g*, as its name implies, is electrically conductive, being made of metal or another suitable material. Although shown extending beyond the hole 14*g*, the conductive tube 22*g* may be the same length as the thickness of the nozzle body 12*g* such that the conductive tube 22*g* would terminate at the exterior of the body 12*g*. A wire 26*g* would connect the conductive tube 22*g* to a charging source to charge the tube 22*g* for electrospinning. Although only one conductive tube 22*g* is shown, multiple tubes 22*g* could be employed in multiple holes 14*g*, and separate wires 26*g* could be employed, or a single wire could extend to charge each conductive tube 22*g*.

FIG. 10 provides a way to introduce the small spinning pores without having to drill the spinning pores through a thin film. The drops of fiber-forming media will hang from the end of the conductive tube and are not likely to spread due to wettability properties of the fiber-forming media on the tube wall. Preventing such spread is desirable, because, if drops of the fiber-forming media spread, they tend to coalesce with other drops and thus reduce the number of jets that are launched.

In one or more embodiments, the nozzle body 12*g* has a thickness greater than 100 microns. In one or more other embodiments, the nozzle body 12*g* has a thickness greater than 1 mm, in other embodiments greater than 2 mm, in yet other embodiments greater than 5 mm and in yet other embodiments greater than 10 mm. By employing a nozzle constructed as is nozzle 10*g*, it is possible to drill larger holes through the nozzle body 12*g*, using standard drill bits, and the desired smaller spinning pore 18*g* can be readily provided through the conductive tubes.

In one or more embodiments, the hole 14*g* is greater than 1 mm in diameter. In one or more other embodiments, the hole 14*g* is greater than 2 mm in diameter, in other embodiments, greater than 3 mm in diameter, and in yet other embodiments, greater than 5 mm. Similarly, in one or more embodiments, the hole 14*g* is less than 5 mm in diameter. In one or more other embodiments, the hole 14*g* is less than 3 mm in diameter, in other embodiments, less than 2 mm in diameter, and in yet other embodiments, less than 1 mm. In one or more embodiments, pathway through the conductive tubes terminate in a spinning pore 18*g* that is greater than 20 microns in diameter. In one or more other embodiments, the spinning pore 18*g* is greater than 100 microns in diameter, in other embodiments, greater than 200 microns in diameter, and in yet other embodiments, greater than 500 microns. Similarly, in one or more embodiments, the spinning pore 18*g* is less than 1 mm in diameter. In one or more other embodiments, the spinning pore 18*g* is less than 500 microns in diameter, in other embodiments, less than 200 microns in diameter, and in yet other embodiments, less than 100 microns.

In a particular embodiment, a PVC pipe having a wall of 3 mm thick forms the nozzle. This nozzle has 100 holes of 0.5 mm drilled therein. Into each such hole is inserted a steel tube having a pathway of 250 microns in diameter to provide a spinning pore at its terminal end of 250 microns in diameter.

Although not shown, it should be appreciated that the various interior cone, shells or lip structures disclosed with respect to FIGS. 3*a*, 3*b* and 3*c* can be incorporated into suitable nozzle structures made in accordance with FIG. 10.

Due in part to the use of one or more interior structures within nozzles 10 and 10*a-g*, as per the teaching relating to FIGS. 3*a-c*, it is possible to more accurately control and/or adjust the pressure of the fiber forming media/material being provided to the nozzle of the present invention. As is discussed above, the present invention is not limited to any specific range of pressure needed to form fibers in accordance with the method disclosed herein. Rather, any range of pressures can be used including pressures greater than or less than atmospheric pressure, and such ranges depend largely upon the size of the pores or holes in the nozzle and the viscosity of the fiber forming media or fluid. In another embodiment, the pressure necessary to form fibers in accordance with a method of the present invention can be further controlled by altering the number of shelves, cones or lips formed on the interior surface of nozzles 10 or 10*a-g*, and/or altering the depth of the one or more catches 104 created by the one or more shelves, cones or lips formed on the interior surface of nozzles 10 or 10*a-g*.

In one embodiment of the present invention nozzles 10 and 10*a-g* are fitted with a fluid recovery system at the bottom end thereof. Such a fluid recovery system permits excess fiber forming media/material to be re-circulated thereby allowing for greater control of the pressure within nozzles 10 and 10*a-g*.

A fiber forming apparatus in accordance with the present invention includes at least one nozzle in accordance with the present invention. In another embodiment, the fiber forming apparatus of the present invention includes at least about 5 nozzles, at least about 10 nozzles, at least about 20 nozzles, at least about 50 nozzles, or even at least about 100 nozzles in accordance with the present invention. In still another embodiment, any number of nozzles can be utilized in the fiber forming apparatus of the present invention depending upon the amount of fibers to be produced. It should be noted that each nozzle and/or any group of nozzles can be designed to be independently controlled. This permits, if so desired, the simultaneous production of different sized fibers (possibly of different fiber-forming media). Additionally, different types of nozzles can be used simultaneously in order to obtain a mixture of fibers having various fiber-geometries and/or sizes.

Examples Relating to FIGS. 3, 4 and 5:

A 20% wt Nylon 6 solution is pushed at about 5 psig or less through the pores of nozzle 10. Multiple jets of fiber-forming media develop from the surface of nozzle 10 (see FIGS. 3*a* to 3*g*) fed by the liquid fiber-forming media flowing through the pores of nozzle 10. In the embodiments shown in FIGS. 4*a* to 4*h* nozzle 10 is porous on the lower portion thereof. However, as noted above, nozzle 10 can, if so desired, be porous throughout any or all of the cylindrical height of nozzle 10. The fibers formed via the apparatus pictured in FIGS. 4*a* to 4*h* are nanofibers having nanoscale diameters as described above. Sometimes the fibers break away from the surface of nozzle 10 prior to reaching the collector 30 (the chicken-mesh type structure shown in the background of FIGS. 4*a* to 4*h*). This is not a problem. Rather, such fibers just have short lengths. The length of the fibers can, to a certain degree, be controlled by the amount of current applied via electrode 20 and/or the electric or ground state of collector 30.

The Nylon 6 for use in the apparatus of FIGS. 4*a* to 4*h* is prepared as follows. Nylon 6 from Aldrich is used as received. A polymer solution having a concentration ranging 20 to 25 weight percent is prepared by dissolving the polymer in 88% formic acid (Fisher Chemicals, New Jersey, USA).

Nozzle 10 for use in the embodiments of FIGS. 4*a* to 4*h* is generally, a porous plastic product that is manufactured from a thermoplastic polymer. In this case the thermoplastic polymer is high density polyethylene (HDPE), ultra-high molecular weight polyethylene (UHMW), polypropylene (PP), or combinations thereof (although other polymers or materials can be used to form nozzle 10, as is described above). In this embodiment, nozzle 10 has an intricate network of interconnected pores (although any configuration of pores is within the scope of the present invention). In the case where a polymer is used to form nozzle 10, a selected particle size distribution among the particles of polymer used to form nozzle 10 usually produces a characteristic range of pore structures and pore sizes.

In the case of the present examples, porous polypropylene having pore sizes of about 10 to 20 microns are used to construct a cylindrical nozzle 10 shown in FIGS. 1 and 4*a* to 4*h*. The cylinder has an internal diameter of one-half inch, and external diameter of one inch, with the bottom end sealed and the top fitted with a fitting for applying air pressure. An electrode 20 is inserted through the bottom surface for applying the voltage to the polymer solution within the nozzle 10.

In one embodiment, the pores in nozzle 10 have sufficient resistance to the flow of unpressurized fiber-forming media (e.g., polymer solution), to prevent jets from forming on the exterior of nozzle 10 prior to the application of pressure to the fiber-forming media. The resistance to flow is caused by the small diameter of the pores of the porous wall and by the thickness of the porous wall. The polymer solution flow through the wall is controlled by the applied pressure at the top of the nozzle. Such pressure can be produced by any suitable means (e.g., a pump, the use of air or some other gas that does not react with the fiber-forming material). A slow controlled flow rate allows the formation of independent droplets at many points on the surface of the porous nozzle 10. The solution flows through the pores and droplets grow on the surface until any number of independent jets form. The pressure to nozzle 10 should be applied in such a manner that the droplets do not spread on the surface of nozzle 10, thereby becoming interconnected and failing to form at least a significant amount of independent jets.

As is discussed above, it is possible to use materials having smaller pore sizes to form the porous nozzle 10 of the present invention. The method by which the pores are formed in nozzle 10 is not critical (pores may be formed by sintering, etching, laser drilling, mechanical drilling, etc.). Generally speaking, the smaller the pores in nozzle 10, the smaller the diameter of fibers produced via the apparatus of the present invention.

In one instance, the polymer material flows through pores in a sintered metal nozzle 10, yielding a thin coating of fiber-forming media on the surface of nozzle 10 from which jets of fiber-forming media emerged at the outer surface of the coating and flowed away from the coated surface of nozzle 10.

In another instance, it is observed that fiber-forming media flows through the pores of nozzle 10 and creates discrete droplets on the surface of nozzle 10. The droplets continue to grow until the electrical field causes an electrically charged jet of solution to emanate from the droplets. The jet carries fluid away from a droplet faster that fluid arrives at the droplet through the pores, so that the droplet shrinks and the jet becomes smaller and stops. Then the electric field causes a new jet to emanate from another droplet and the process repeats.

As a source for electrode 20, a variable high voltage power supply (0 to 32 kV) can be used as a power supply (although the present invention is not limited thereto). The polymer solution is placed in the nozzle. Compressed air is the source of pressure used to push the polymer through the porous walls of nozzle 10.

The polymer solution flows slowly through the walls and forms small drops on the outside of the walls. With the aid of the electric field the drops form jets that flow towards the collector. The jets that form may be stable for a period of time or the jets may be intermittent, disappearing as the drop decreases in size due to a jet of polymer leaving the drop, and possibly reforming when the drop reappears.

In the present examples, the collector 30 is a cylindrical mesh of chicken wire coaxial with the nozzle and surrounding the nozzle. The cylindrical collector 30 has a diameter of about 6 inches.

As is discussed above, the present invention is not limited to just the use of a "chicken-wire" type collector 30, or to a cylindrically-shaped nozzle 10. Instead, any 3-dimensional shape can be used for nozzle 10. Additionally, other shapes/types of collectors can be utilized in an apparatus in accordance with the present invention.

Furthermore, in one embodiment, part of nozzle 10 can be impermeable and part permeable to direct the flow of the fibers towards a particular part of the collector. The collector surface may be curved or flat. The collector may move as a belt around or past the nozzle to collect a large sheet of fibers from the nozzle, as shown in FIG. 2.

Several jets that lasted for a period of time (many minutes) and many intermittent jets that lasted for much shorter periods of time are formed all over the surface of the nozzle as seen in FIGS. 4*a* to 4*h*. The fibers formed are collected on a cylindrical wire mesh surrounding the nozzle. FIGS. 4*f* to 4*h* are fuzzy due to the presence of the fibers on the mesh blocking the view of the camera.

FIGS. 5*a* to 5*f* are SEM images of samples of fibers manufactured from the apparatus depicted in FIGS. 4*a* to 4*h*. The images show clearly that the fibers produced are nanofibers of dimensions (of less than about 100 nm to about 1000 nm in diameter) and are comparable to those produced from a conventional needle arrangement. Fibers in this size range are suitable for many purposes including, but not limited to, packaging, food preservation, medical, agricultural, batteries and fuel cell applications.

The production rate of nanofibers is large compared to a single needle arrangement electrospinning apparatus. A typical needle produces nanofibers at a rate of about 0.02 g/hr. The porous nozzle used in this experiment produced nanofibers at a rate greater than about 5 g/hr or a production rate of about 250 times greater.

The present process is readily applicable to any polymer solution or melt that can be electrospun via a needle arrangement. The porous nozzle material must be chemically compatible with the polymer solution.

The present invention can also be used to add any desired chemical, agent and/or additive on, in or about fibers produced via electrospinning. Such additives include, but are not limited to, pesticides, fungicides, anti-bacterials, fertilizers, vitamins, hormones, chemical and/or biological indicators, protein, growth factors, growth inhibitors, antioxidants, dyes, colorants, sweeteners, flavoring compounds, deodorants, processing aids, etc.

The pores in sintered materials can be smaller than the diameters of needles often used for electrospinning. Smaller diameter pores may make it possible to make smaller diameter fibers. Thus, the present invention makes possible the use materials having pores of sizes much smaller than even those discussed in the above examples.

An increase in the production rate is also possible with the present invention without having to place in close proximity a large number of needles for electrospinning. The presence of a large amount of needles in close proximity has an affect on the geometry of the electric field used in electrospinning and causes jets to form from some needles and not others.

Example Related to FIG. 6 (Film Providing Spinning Pore):

Polyvinylpyrolidone (PVP) solution was spun from a 1 m long PVC pipe 2.5 cm outside diameter, 2 cm inside diameter, with 100 holes along its length, each 1 mm in diameter, covered with an acrylic thin film with 50 micron pores coaxial with the 1 mm holes. Positioned coaxially inside of the pipe was a 1 cm diameter solid steel rod serving as the electrode. The PVP solution was prepared by dissolving polyvinylpyrrolidone (PVP) in ethanol to a concentration of 10% PVP by mass. Sufficient pressure was applied to the PVP solution to form droplets at the surfaces of the pores. Production rate from this device was about 1 g of nanofiber per hour.

Example Related to FIG. 10 (Conductive Tube Providing Spinning Pore):

The same PVP solution as in the example directly above was spun in a PVC pipe equipped with metal tubes (as in accordance with FIG. 10 and the description herein). The holes were about 0.5 to 1 mm in diameter and small metal tubes having pathways that established 0.2 mm spinning pores were inserted into the holes. The tubes protruded about 1 cm from the PVC pipe wall and were electrically charged by attaching wires to each metal tube. The PVP solution was pressurized to form drops at the tips of the metal tubes. This device produced fibers at a rate of about 30 g per day.

Example Related to FIG. 7 (Hemispherical Nozzle):

A polyvinylchloride (PVC) hemisphere nozzle was designed with a 7 cm diameter and 5 mm wall thickness. Into the wall were formed 24 spinning pores of 200 microns in diameter, the pores being randomly distributed over the surface. This nozzle was charged with a PVP solution as in the examples above, and the droplets formed at the pores jetted to a flat plate collector to produce a circular pattern of fibers. This device produced fibers at a rate of about 1 g per day.

Various modifications and alterations that do not depart from the scope and spirit of this invention will become apparent to those skilled in the art. This invention is not to be duly limited to the illustrative embodiments set forth herein.

What is claimed is:

1. An electrospinning nozzle comprising:

a nozzle body having a hole therein, and a film covering said hole and providing a spinning pore aligned with said hole, said spinning pore being smaller in cross-section than said hole.

2. The electrospinning nozzle of claim 1, wherein said hole is provided by the natural porosity of the material forming said nozzle body.

3. An electrospinning nozzle comprising:

a tubular nozzle body having an inner tubular surface for holding fiber-forming media; and a conductive spring having a flat cross section and being secured at its outer circumference to said inner surface of said tubular nozzle body, whereby said conductive spring serves as an electrode to charge fiber-forming media within said tubular nozzle body and further serves to define a continuous shelf and catch for fiber-forming media forced into and through said tubular nozzle body.

* * * * *